US012709863B2

(12) United States Patent
Hashimoto et al.

(10) Patent No.: US 12,709,863 B2
(45) Date of Patent: Aug. 18, 2026

(54) CONSTRUCTION MACHINE

(71) Applicants: HIROSHIMA UNIVERSITY, Higashi-Hiroshima-shi (JP); KOBELCO CONSTRUCTION MACHINERY CO., LTD., Hiroshima-shi (JP)

(72) Inventors: Ryota Hashimoto, Hiroshima (JP); Yasuhiko Shimazu, Hiroshima (JP); Sho Okimoto, Hiroshima (JP)

(73) Assignees: HIROSHIMA UNIVERSITY, Higashi-Hiroshima (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 127 days.

(21) Appl. No.: 18/569,875

(22) PCT Filed: Apr. 21, 2022

(86) PCT No.: PCT/JP2022/018376
§ 371 (c)(1),
(2) Date: Dec. 13, 2023

(87) PCT Pub. No.: WO2023/276421
PCT Pub. Date: Jan. 5, 2023

(65) Prior Publication Data

US 2024/0279902 A1 Aug. 22, 2024

(30) Foreign Application Priority Data

Jun. 29, 2021 (JP) ..... 2021-107525

(51) Int. Cl.
*E02F 3/43* (2006.01)
*E02F 3/32* (2006.01)
(Continued)

(52) U.S. Cl.
CPC ..... *E02F 3/439* (2013.01); *E02F 3/32* (2013.01); *E02F 3/40* (2013.01); *E02F 9/261* (2013.01); *E02F 9/265* (2013.01); *E02F 9/2004* (2013.01)

(58) Field of Classification Search
CPC ..... E02F 3/439; E02F 3/32; E02F 3/40; E02F 9/261; E02F 9/265; E02F 9/2004;
(Continued)

(56) References Cited

U.S. PATENT DOCUMENTS

2015/0149049 A1* 5/2015 Bewley ..... E02F 9/2883 37/444
2018/0230671 A1 8/2018 Wu
(Continued)

FOREIGN PATENT DOCUMENTS

CN 1705827 A 12/2005
JP 62-160325 A 7/1987
(Continued)

OTHER PUBLICATIONS

International Search Report issued Jun. 28, 2022 in PCT/JP2022/018376, filed on Apr. 21, 2022, 2 pages.
(Continued)

*Primary Examiner* — Anne Marie Antonucci
*Assistant Examiner* — Jewel A Kuntz
(74) *Attorney, Agent, or Firm* — Oblon, McClelland, Maier & Neustadt, L.L.P.

(57) ABSTRACT

A construction machine is capable of preventing degradation in efficiency of excavation work while preventing an increase in excavation resistance in the excavation work. A controller of a construction machine determines an accommodation state of earth and sand accommodated in a bucket, and outputs a resistance reduction command signal that is a command signal for operating a work device such that the
(Continued)

bucket is displaced in a resistance reduction direction that is a direction where excavation resistance acting on the bucket is capable of being reduced, in accordance with a result of determining the accommodation state.

7 Claims, 9 Drawing Sheets

(51) Int. Cl.

| | |
|---|---|
| ***E02F 3/40*** | (2006.01) |
| ***E02F 9/20*** | (2006.01) |
| ***E02F 9/26*** | (2006.01) |

(58) Field of Classification Search
CPC . E02F 3/434; E02F 3/437; E02F 9/205; E02F 3/432; E02F 3/436
See application file for complete search history.

(56) References Cited

U.S. PATENT DOCUMENTS

| | | | | |
|---|---|---|---|---|
| 2020/0115882 | A1* | 4/2020 | Sano | E02F 9/2267 |
| 2021/0002853 | A1* | 1/2021 | Yamashita | E02F 9/2203 |

FOREIGN PATENT DOCUMENTS

| | | | |
|---|---|---|---|
| JP | 8-81977 | A | 3/1996 |
| JP | 2011-252338 | A | 12/2011 |
| JP | 2013-253436 | A | 12/2013 |
| JP | 2017-172316 | A | 9/2017 |
| WO | WO 2017/047695 | A1 | 3/2017 |

OTHER PUBLICATIONS

Combined Chinese Office Action and Search Report issued Dec. 17, 2025 in Chinese Patent Application No. 202280044433.X with English Machine translation, 27 pgs.

* cited by examiner

CONSTRUCTION MACHINE

TECHNICAL FIELD

The present disclosure relates to a construction machine such as a hydraulic excavator.

BACKGROUND ART

Patent Literature 1 discloses a hydraulic excavator that measures a magnitude of an excavation reaction force applied to a bucket from the ground in excavation during which the bucket enters the ground for excavating the ground, changes a slewing position of a boom in accordance with the measured magnitude of the excavation reaction force, and causes the boom to deflect a travelling direction of the bucket upward when the measured excavation force is great.

Patent Literature 2 discloses a work machine control device of a power excavator. The work machine control device includes a first detection unit that detects angles of a bucket, an arm, and a boom of a power excavator, a storage unit that stores a movement locus of a blade edge of the bucket in an excavation state in which excavation resistance is weak and the bucket is nearly full, a first control unit that controls an attitude of the bucket based on angle information about the bucket, the arm, and the boom, the angle information being detected by the detection unit, and movement locus information about the bucket blade edge read from the storage unit, a second detection unit that detects that the excavation resistance of the bucket becomes equal to or greater than a set value, and a unit that corrects the movement locus information about the bucket blade edge read from the storage unit in a direction where the excavation resistance becomes weak in response to an output from the second detection unit.

The construction machines of Patent Literature 1 and 2 detect an excavation reaction force (excavation resistance) applied to the bucket from the ground in the excavation work, and when the detected excavation reaction force (excavation resistance) is great, the travelling direction of the bucket is corrected upward so that the excavation resistance becomes weak.

In the construction machines of Patent Literature 1 and 2, since a determination is made whether to reduce the excavation resistance in the excavation work only based on the excavation reaction force as described above, the efficiency of the excavation work is not necessarily satisfactory. Specifically, for example, in a case where the resistance (penetration resistance) is great when the teeth of the bucket enter the ground, control is performed so that the travelling direction of the bucket is corrected upward and the excavation resistance is reduced. In this case, the amount of earth and sand in the bucket at the completion of excavation by the bucket may be significantly small with respect to the capacity of the bucket. On the other hand, in a case where, for example, the excavation resistance of the bucket does not reach the set value due to the earth property although the amount of the earth and sand in the bucket reaches the capacity of the bucket, the travelling direction of the bucket is maintained as it is. In this case, although the amount of the earth and sand in the bucket is sufficient, the bucket continues to excavate a deep portion of the ground, and thus wasteful energy is consumed. Therefore, in the construction machines of Patent Literature 1 and 2, it cannot be necessarily said that efficiency of excavation work is satisfactory.

CITATION LIST

Patent Literature

Patent Literature 1: JP H8-81977 A
Patent Literature 2: JP S62-160325 A

SUMMARY OF INVENTION

The present disclosure has been made in view of the above problems, and an object of the present disclosure is to provide a construction machine capable of preventing degradation of the efficiency of excavation work while preventing an increase in the excavation resistance in the excavation work.

Provided is a construction machine including: a machine body; a work device including a boom supported to the machine body to be capable of being raised and lowered, an arm rotatably supported to the boom, and a bucket supported to the arm, the bucket having a bucket base end portion that is a base end portion rotatably attached to the arm, a bucket tip portion that is a tip portion on an opposite side of the bucket base end portion, and an inner surface defining an accommodation space that is a space capable of accommodating earth and sand; at least one operation device that causes the work device to perform excavation work so that earth and sand on a ground is excavated by displacing the bucket with respect to the ground while maintaining a state where a portion including at least the bucket tip portion is in contact with the ground at an excavation attitude that is an attitude of the bucket at which the bucket base end portion is disposed at a position higher than the bucket tip portion and is an attitude at which the earth and sand on the ground is capable of being excavated; and a controller, in which the controller determines an accommodation state of the earth and sand accommodated in the bucket, and outputs a resistance reduction command signal that is a command signal for operating the work device so that the bucket is displaced in a resistance reduction direction that is a direction where excavation resistance acting on the bucket is capable of being reduced, in accordance with a result of determining the accommodation state.

DESCRIPTION OF EMBODIMENTS

Figure 1:
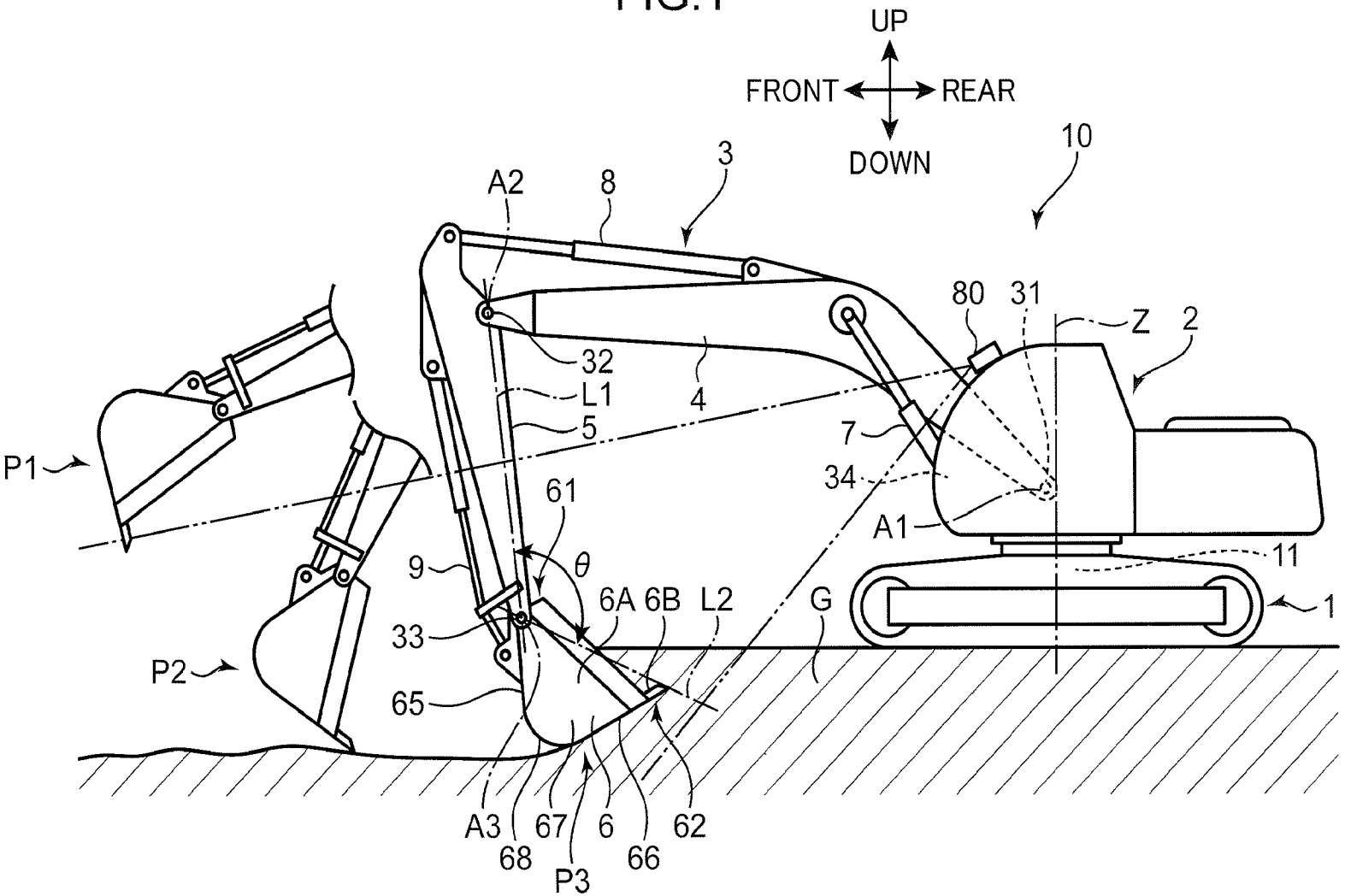
FIG. 1 is a side view of a hydraulic excavator according to an embodiment of the present disclosure.

Embodiments of the present disclosure will be described with reference to the drawings. FIG. 1 is a side view of a hydraulic excavator 10 according to the present embodiment. As illustrated in FIG. 1, the hydraulic excavator 10 includes a lower travelling body 1 capable of travelling on a ground G, an upper slewing body 2 supported to the lower travelling body 1 so as to be able to slew about a slewing center axis Z facing a vertical direction, and a work device 3 supported to the upper slewing body 2. The lower travelling body 1 and the upper slewing body 2 are an example of a machine body. Note that "front" and "rear" in the drawings are directions based on an orientation of the upper slewing body 2.

The lower travelling body 1 includes a pair of crawler travelling devices and a lower frame connecting these travelling devices. The upper slewing body 2 includes an upper frame supported to the lower frame to be able to slew, a cabin supported to a front portion of the upper frame, and a counterweight supported to a rear portion of the upper frame. In the present embodiment, the work device 3 includes a boom 4, an arm 5, and a bucket 6.

The boom 4 is supported to the upper frame so as to be raised and lowered with respect to the upper frame of the upper slewing body 2. Specifically, the boom 4 includes a boom base end portion that is a base end portion attached to the upper frame to be rotatable in upward and downward directions about a horizontal axis A1, and a boom tip portion that is a tip portion on the opposite side of the base end portion.

The arm 5 is supported to the boom 4 so as to be rotatable with respect to the boom 4. Specifically, the arm 5 includes an arm base end portion that is a base end portion attached to the boom tip portion to be rotatable in an arm pulling direction and an arm pushing direction about a horizontal axis A2, and an arm tip portion that is a tip portion on the opposite side of the base end portion. The arm pulling direction is a rotating direction where the arm tip portion of the arm 5 approaches the machine body, and the arm pushing direction is a rotating direction opposite to the arm pulling direction.

The bucket 6 is supported by the arm 5 so as to be rotatable with respect to the arm 5.

Specifically, the bucket 6 includes a bucket base end portion 61 that is a base end portion attached to the arm tip portion to be rotatable in a bucket pulling direction and a bucket pushing direction about a horizontal axis A3, and a bucket tip portion 62 that is a tip portion on the opposite side of the base end portion. The bucket pulling direction is, for example, a rotating direction where the bucket tip portion 62 approaches the machine body in a case where the bucket 6 performs the excavation operation as illustrated in FIG. 1, and the bucket pushing direction is a rotating direction opposite to the bucket pulling direction.

The bucket 6 includes a bucket main body 6A including the bucket base end portion 61 and a plurality of teeth 6B (a plurality of claws). The bucket main body 6A constitutes a vessel portion of the bucket 6 and has an accommodation space that is a space where earth and sand can be accommodated. The bucket main body 6A has an inner surface that defines the accommodation space. The plurality of teeth 6B constitute the bucket tip portion 62 of the bucket 6, and is fixed to the end portion of the bucket main body 6A so as to be aligned along a widthwise direction of the bucket main body 6A. The widthwise direction of the bucket main body 6A is a direction parallel to the horizontal axis A3 and is a left-right direction. Each of the plurality of teeth 6B protrudes from the end portion of the bucket main body 6A in a direction orthogonal to the widthwise direction.

Each of the bucket pulling direction and the bucket pushing direction can be defined using, for example, an angle of the bucket 6 with respect to the arm 5. An angle formed by a straight line L1 and a straight line L2 is defined as a bucket angle θ. The straight line L1 passes through the horizontal axis A2 which is the rotation center of the arm base end portion and the horizontal axis A3 which is the rotation center of the bucket base end portion. The straight line L2 passes through the horizontal axis A3 and the tip of the bucket 6 (the tips of the teeth 6B). In this case, the bucket pulling direction is a rotating direction where the bucket angle θ decreases, and the bucket pushing direction is a rotating direction where the bucket angle θ increases.

The hydraulic excavator 10 further includes a plurality of hydraulic actuators for hydraulically moving the work device 3. The plurality of hydraulic actuators includes a boom cylinder 7, an arm cylinder 8, a bucket cylinder 9, and a slewing motor 11.

Each of the cylinders 7, 8, and 9 is configured by a hydraulic cylinder that receives supply of hydraulic oil to extend and contract. The boom cylinder 7 is attached to the upper slewing body 2 and the boom 4 so that the boom 4 is raised and lowered as the boom cylinder 7 extends and contracts, that is, the boom 4 rotates in a boom raising direction and a boom lowering direction. The arm cylinder 8 is attached to the boom 4 and the arm 5 so that the arm 5 rotates in the arm pulling direction and the arm pushing direction as the arm cylinder 8 extends and contracts. The bucket cylinder 9 is attached to the arm 5 and the bucket 6 so that the bucket 6 rotates in the bucket pulling direction and the bucket pushing direction as the bucket cylinder 9 extends and contracts.

The slewing motor 11 is a hydraulic motor for hydraulically slewing the upper slewing body 2 with respect to the lower travelling body 1. The slewing motor 11 has an output shaft, and the output shaft is connected to the upper frame of the upper slewing body 2 via a reduction gear not illustrated. When receiving the supply of the hydraulic oil, the slewing motor 11 operates so that the output shaft rotates in a direction corresponding to the supply direction, and thus the upper slewing body 2 can slew in each of a left slewing direction and a right slewing direction.

Figure 2:
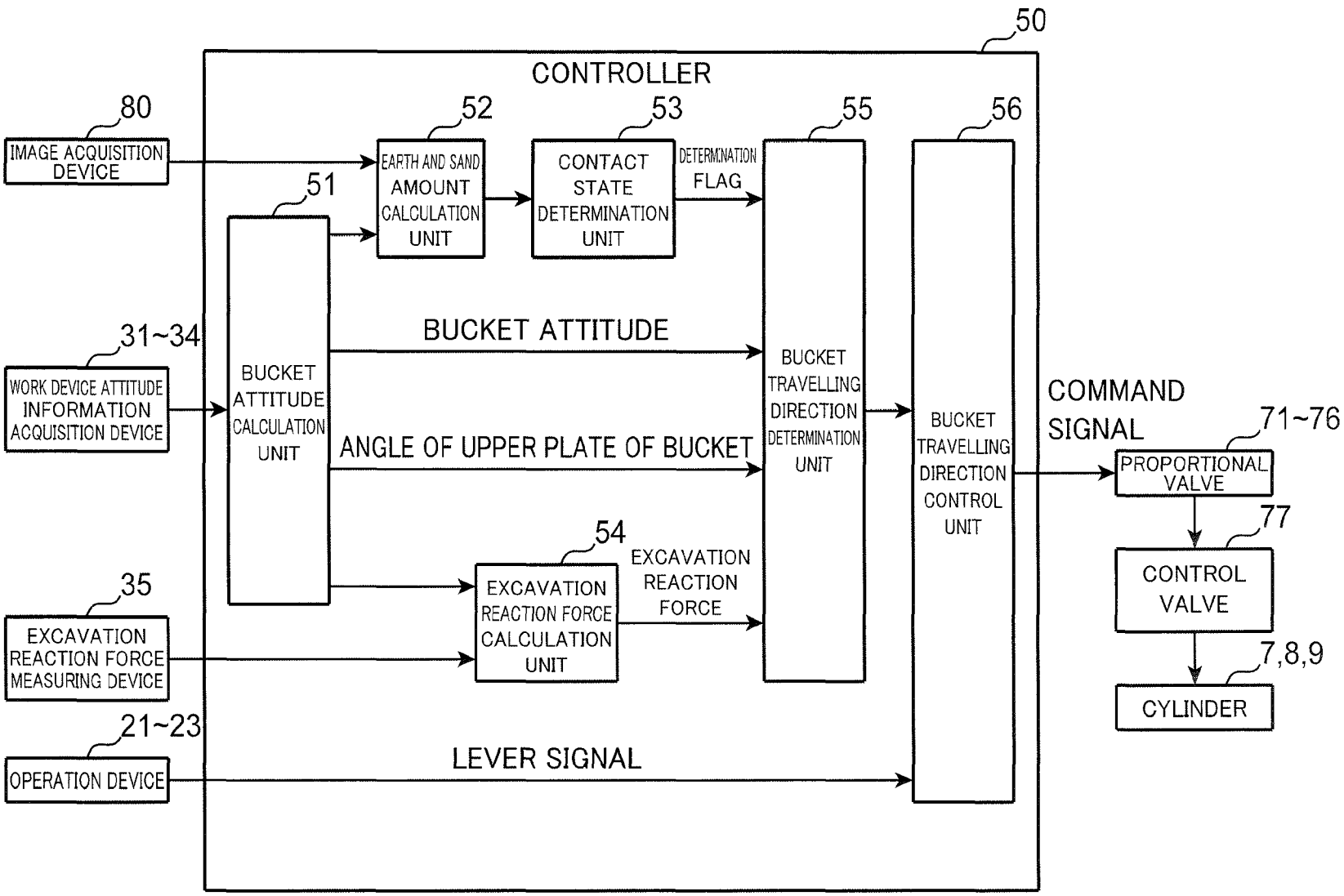
FIG. 2 is a block diagram illustrating a functional configuration of a controller of the hydraulic excavator and input and output signals thereof.

As illustrated in FIG. 2, the hydraulic excavator 10 further includes a plurality of operation devices, a plurality of sensors, and a controller 50.

The plurality of operation devices are devices capable of causing the work device 3 to perform excavation work of excavating earth and sand on the ground G by displacing the bucket 6 with respect to the ground G while maintaining a state where the attitude of the bucket 6 is an excavation attitude and at least a portion including the bucket tip portion 62 is in contact with the ground G.

The plurality of operation devices includes a boom operation device 21, an arm operation device 22, and a bucket operation device 23. Each of these operation devices 21, 22, and 23 includes an operation lever, and is configured by an electric lever device that inputs a lever signal, which is an electric signal corresponding to an operation, to the controller 50 when the operation lever is operated by an operator to operate the work device 3. Specifically, this will be described as follows.

The boom operation device 21 includes a boom operation lever that is operated by the operator to perform a boom operation for operating the boom 4, and a boom operation signal generation unit that generates a boom operation signal that is a lever signal corresponding to the boom operation given to the boom operation lever and inputs the boom operation signal to the controller 50.

The arm operation device 22 includes an arm operation lever that is operated by the operator to perform an arm operation for operating the arm 5, and an arm operation signal generation unit that generates an arm operation signal that is a lever signal corresponding to the arm operation given to the arm operation lever and inputs the arm operation signal to the controller 50.

The bucket operation device 23 includes a bucket operation lever that is operated by the operator to perform a bucket operation for operating the bucket 6, and a bucket operation signal generation unit that generates a bucket operation signal that is a lever signal corresponding to the bucket operation given to the bucket operation lever and inputs the bucket operation signal to the controller 50.

Each of the plurality of sensors detects information necessary for enabling the controller 50 to control the operation of the work device 3, and inputs a detection signal, which is an electric signal corresponding to the information, to the controller 50. The plurality of sensors includes a boom angle sensor 31, an arm angle sensor 32, a bucket angle sensor 33, a plurality of cylinder pressure sensors 35, an image acquisition sensor 80 (image acquisition device), and a machine body tilt angle sensor 34.

The boom angle sensor 31, the arm angle sensor 32, and the bucket angle sensor 33 are examples of a work device attitude information acquisition device that acquires work device attitude information that is information regarding the attitude of the work device 3. The image acquisition sensor 80 is an example of an earth and sand information acquisition device that acquires earth and sand information that is information regarding earth and sand accommodated in the accommodation space of the bucket 6.

The boom angle sensor 31 detects a boom angle, which is an angle of the boom 4 with respect to the upper slewing body 2, and inputs a boom attitude detection signal, which is a detection signal corresponding to the detected boom angle, to the controller 50. The boom angle sensor 31 is disposed at the boom base end portion of the boom 4, for example, as illustrated in FIG. 1.

The arm angle sensor 32 detects an arm angle, which is an angle of the arm 5 with respect to the boom 4, and inputs an arm attitude detection signal, which is a detection signal corresponding to the detected arm angle, to the controller 50. The arm angle sensor 32 is disposed at the arm base end portion of the arm 5, for example, as illustrated in FIG. 1.

The bucket angle sensor 33 detects the bucket angle θ, which is an angle of the bucket 6 with respect to the arm 5, and inputs a bucket attitude detection signal, which is a detection signal corresponding to the detected bucket angle θ, to the controller 50. The bucket angle sensor 33 is disposed at the bucket base end portion 61 of the bucket 6, for example, as illustrated in FIG. 1.

Each of the boom angle sensor 31, the arm angle sensor 32, and the bucket angle sensor 33 may be, for example, a resolver, a rotary encoder, a potentiometer, an inertial measurement unit (IMU), or another sensor.

The machine body tilt angle sensor 34 is a sensor for detecting a tilt angle of the machine body. The machine body tilt angle sensor 34 is disposed, for example, in the upper slewing body 2, detects the tilt angle of the machine body with respect to the horizontal plane, and inputs a detection signal corresponding to the detected tilt angle to the controller 50. The machine body tilt angle sensor 34 may be configured by, for example, an IMU.

The plurality of cylinder pressure sensors 35 includes at least one cylinder pressure sensor that detects the pressure of the boom cylinder 7, at least one cylinder pressure sensor that detects the pressure of the arm cylinder 8, and at least one cylinder pressure sensor that detects the pressure of the bucket cylinder 9. Specifically, in the present embodiment, the plurality of cylinder pressure sensors 35 includes a cylinder pressure sensor that detects the pressure of a head side chamber of the boom cylinder 7, a cylinder pressure sensor that detects the pressure of a rod side chamber of the boom cylinder 7, a cylinder pressure sensor that detects the pressure of a head side chamber of the arm cylinder 8, a cylinder pressure sensor that detects the pressure of a rod side chamber of the arm cylinder 8, a cylinder pressure sensor that detects the pressure of a head side chamber of the bucket cylinder 9, and a cylinder pressure sensor that detects the pressure of a rod side chamber of the bucket cylinder 9. Each of the plurality of cylinder pressure sensors 35 inputs a pressure detection signal, which is a detection signal corresponding to the detected pressure, to the controller 50.

The image acquisition sensor 80 acquires earth and sand information that is information about earth and sand accommodated in the accommodation space of the bucket 6, and inputs the earth and sand information to the controller 50. The image acquisition sensor 80 can measure shape data (for example, initial image information, image information during excavation, and the like to be described later) of the inner surface of the bucket 6 and the earth and sand accommodated in the bucket 6. The image acquisition sensor 80 may include, for example, a distance measuring sensor that measures measurement data indicating a distance of an object. The distance measuring sensor may be, for example, a light detection and ranging (LiDAR). The LiDAR can measure a distance up to an object by irradiating the object with light such as near-infrared light, visible light, and ultraviolet light and capturing reflected light thereof using an optical sensor. The distance measuring sensor may be a sensor, such as a time of flight (TOF) sensor or a stereo camera, capable of measuring a depth in units of a plurality of pixels.

The image acquisition sensor 80 is disposed at a position where the sensor can acquire earth and sand information about the earth and sand accommodated in the accommodation space of the bucket 6 in the excavation work. In the excavation work, for example, as illustrated in FIG. 1, the bucket 6 is displaced in the order of a pre-start position P1 which is a position before the start of the excavation work, a working position P2 which is a position during the excavation work, and a final-phase position P3 which is a position at the final phase of the excavation work. In the present embodiment, the image acquisition sensor 80 is disposed in a cabin of the upper slewing body 2 as illustrated in FIG. 1, and has a field of view (for example, a field of view in a range indicated by a chain double-dashed line in FIG. 1) where the inner surface of the bucket 6 and the earth and sand accommodated in the bucket 6 can be imaged when the bucket 6 is in a range including the working position P2 and the final-phase position P3. Note that the image acquisition sensor 80 may be disposed on a lower surface of the boom 4 or may be disposed on an inner surface of the arm 5. The lower surface of the boom 4 is a surface facing the ground G in FIG. 1 among the plurality of surfaces of the boom 4, and the inner surface of the arm 5 is a surface facing a rear side in FIG. 1 among the plurality of surfaces of the arm 5.

The controller 50 controls the operation of the work device 3 based on operation signals input from the plurality of operation devices and detection signals input from the plurality of sensors. The controller 50 includes a computer including a CPU and a memory.

The controller 50 includes a bucket attitude calculation unit 51, an earth and sand amount calculation unit 52, a contact state determination unit 53, an excavation reaction force calculation unit 54, a bucket travelling direction determination unit 55, and a bucket travelling direction control unit 56.

The bucket attitude calculation unit 51 calculates a bucket attitude which is an attitude of the bucket 6 using the work device attitude information. Specifically, the bucket attitude calculation unit 51 calculates the bucket attitude based on a boom attitude detection signal input from the boom angle sensor 31, the arm attitude detection signal input from the arm angle sensor 32, and the bucket attitude detection signal input from bucket angle sensor 33.

The earth and sand amount calculation unit 52 calculates an accumulation state of the earth and sand in the accommodation space of the bucket 6 using the bucket attitude and the earth and sand information. The earth and sand amount calculation unit 52 is an example of an accumulation state calculation unit.

The contact state determination unit 53 determines a contact state between a specific upper region 64 on the inner surface of the bucket 6 and earth and sand. In the present embodiment, the contact state determination unit 53 determines the contact state based on the accumulation state calculated by the earth and sand amount calculation unit 52. The contact state determination unit 53 stores data indicating a result of determining the contact state in a predetermined region (flag) of the memory. The contact state determination unit 53 is an example of an accommodation state determination unit.

The specific upper region 64 is a portion on the inner surface of the bucket 6 located at the upper portion at the excavation attitude. As illustrated in FIG. 1, the excavation attitude is an attitude of the bucket 6 at which the bucket base end portion 61 is disposed at a position higher than the bucket tip portion 62, and is an attitude at which an opening of the bucket 6 faces the rear side and the bucket 6 can excavate the earth and sand on the ground G like a case where the bucket 6 is disposed at the working position P2 and the final-phase position P3.

As illustrated in FIG. 1, the bucket 6 includes an upper plate 65 positioned on an upper portion at the excavation attitude, a lower plate 66 positioned on a lower portion at the excavation attitude, a bottom plate 68 curved to connect the upper plate 65 and the lower plate 66, a right plate (not illustrated) connected to a right edge of the upper plate 65, a right edge of the bottom plate 68, and a right edge of the lower plate 66, and a left plate 67 connected to a left edge of the upper plate 65, a left edge of the bottom plate 68, and a left edge of the lower plate 66. The inner surface of the bucket 6 includes an inner surface of the upper plate 65, an inner surface of the bottom plate 68, and an inner surface of the lower plate 66, and does not include an inner surface of the right plate and an inner surface of the left plate. For example, as illustrated in an upper diagram of FIG. 3, the specific upper region 64 is a portion located above a boundary portion PS of the bucket 6 on the inner surface of the bucket 6. In the present embodiment, the boundary portion PS is a portion located on a foremost side of the inner surface of the bucket 6 at the excavation attitude.

Therefore, the boundary portion PS is a portion that changes in accordance with the attitude of the bucket 6. The contact state determination unit 53 can calculate the position of the boundary portion PS based on the bucket attitude calculated by the bucket attitude calculation unit 51. Note that the boundary portion PS may be a predetermined specific portion (fixed portion) instead of the portion that changes in accordance with the attitude of the bucket 6. In a case where the boundary portion PS is the fixed portion, the boundary portion PS may be, for example, a portion (bottom portion) located at the lowest position when the opening of the bucket 6 is disposed parallel to the horizontal plane. Further, on the inner surface of the bucket 6, the boundary portion PS may be set to include the left end to the right end of the inner surface on a horizontal straight line parallel to the widthwise direction of the bucket 6, or may be set for each of a plurality of regions in the widthwise direction to have different height positions. The boundary portion P'S is not necessarily set to include the left end to the right end of the inner surface, and may be set only in a partial region in the widthwise direction.

The excavation reaction force calculation unit 54 calculates an excavation reaction force based on the tilt angle of the machine body, the tilt angle being detected by the machine body tilt angle sensor 34 (the attitude of the upper slewing body 2), the attitude of the work device 3, the attitude being detected by the boom angle sensor 31, the arm angle sensor 32, and the bucket angle sensor 33 (the attitude of the boom 4, the attitude of the arm 5, and the attitude of the bucket 6), the pressure of the boom cylinder 7, the pressure of the arm cylinder 8, and the pressure of the bucket cylinder 9, the pressures being detected respectively by the plurality of cylinder pressure sensors 35, and dimension information about a dimension between the links in the work device 3. The dimension between the links is stored in advance in a storage unit of the controller 50, and includes, for example, a distance between the horizontal axis A1 and the horizontal axis A2, and a distance between the horizontal axis A2 and the horizontal axis A3. The machine body tilt angle sensor 34, the boom angle sensor 31, the arm angle sensor 32, the bucket angle sensor 33, and the plurality of cylinder pressure sensors 35 are examples of an excavation reaction force measuring device.

The bucket travelling direction determination unit 55 and the bucket travelling direction control unit 56 are examples of a work device control unit. The work device control unit outputs a resistance reduction command signal in accordance with the determination result from the contact state determination unit 53, the resistance reduction command signal being a command signal for operating the work device 3 so that the bucket 6 is displaced in the resistance reduction direction, which is a direction where the excavation resistance acting on the bucket 6 can be reduced. Specifically, this will be described as follows.

The bucket travelling direction determination unit 55 determines whether the excavation resistance acting on the bucket 6 needs to be reduced by controlling the travelling direction of the bucket 6. In the present embodiment, the bucket travelling direction determination unit 55 determines whether the excavation resistance acting on the bucket 6 needs to be reduced based on the determination result (determination flag) from the contact state determination unit 53, the bucket attitude calculated by the bucket attitude calculation unit 51, and the excavation reaction force calculated by the excavation reaction force calculation unit 54.

The bucket travelling direction control unit 56 outputs a command signal for operating the work device 3 based on the lever signals input from the plurality of operation devices and the determination result from the bucket travelling direction determination unit 55. That is, the bucket travelling direction control unit 56 outputs the command signal for operating the work device 3 based on a boom operation signal input from the boom operation device 21, an arm operation signal input from the arm operation device 22, a bucket operation signal input from the bucket operation device 23, and a determination result from the bucket travelling direction determination unit 55.

In a case where the bucket travelling direction determination unit 55 determines that the excavation resistance acting on the bucket 6 does not need to be reduced, the bucket travelling direction control unit 56 outputs command signals corresponding to the boom operation signal, the arm operation signal, and the bucket operation signal to a work device drive unit. On the other hand, in a case where the bucket travelling direction determination unit 55 determines that the excavation resistance acting on the bucket 6 needs to be reduced, the bucket travelling direction control unit 56 outputs a resistance reduction command signal, which is a command signal for operating the work device 3 so that the bucket 6 is displaced in the resistance reduction direction, which is a direction where the excavation resistance acting on the bucket 6 can be reduced, to the work device drive unit. The resistance reduction command signal includes a correction command signal obtained by correcting at least one of the command signals corresponding to the boom operation signal, the arm operation signal, and the bucket operation signal.

The work device drive unit includes a plurality of proportional valves and a control valve unit 77. The plurality of proportional valves includes a pair of boom proportional valves 71 and 72, a pair of arm proportional valves 73 and 74, and a pair of bucket proportional valves 75 and 76. Each of the proportional valves 71 to 76 is configured by, for example, an electromagnetic proportional valve. The control valve unit 77 includes a boom control valve, an arm control valve, and a bucket control valve.

The control valve unit 77 is interposed between a hydraulic pump, not illustrated, and a plurality of hydraulic actuators, and adjusts a flow rate and a supply direction of hydraulic oil supplied to each of the plurality of hydraulic actuators.

Specifically, the control valve unit 77 includes a boom control valve that adjusts a flow rate and a supply direction of hydraulic oil supplied to the boom cylinder 7, an arm control valve that adjusts a flow rate and a supply direction of hydraulic oil supplied to the arm cylinder 8, and a bucket control valve that adjusts a flow rate and a supply direction of hydraulic oil supplied to the bucket cylinder 9.

In a case where the bucket travelling direction determination unit 55 determines that the excavation resistance acting on the bucket 6 does not need to be reduced, the bucket travelling direction control unit 56 outputs command signals corresponding to the boom operation signal, the arm operation signal, and the bucket operation signal to the plurality of proportional valves 71 to 76 of the work device drive unit. Specifically, this will be described as follows.

When the boom operation signal is input from the boom operation device 21, the bucket travelling direction control unit 56 inputs a boom command signal, which is a command signal corresponding to the boom operation signal, to the boom proportional valve corresponding to the operation direction of the boom operation among the pair of boom proportional valves 71 and 72. As a result, a pilot pressure reduced in the boom proportional valve in accordance with the boom command signal is input to one of a pair of pilot ports of the boom control valve. As a result, since the hydraulic oil of the hydraulic pump is supplied to one of the head side chamber and the rod side chamber of the boom cylinder 7 corresponding to the boom command signal at a flow rate corresponding to the boom command signal, the boom 4 rotates in a direction corresponding to the boom command signal at a speed in accordance with the boom command signal.

When the arm operation signal is input from the arm operation device 22, the bucket travelling direction control unit 56 inputs an arm command signal, which is a command signal corresponding to the arm operation signal, to the arm proportional valve corresponding to the operation direction of the arm operation among the pair of arm proportional valves 73 and 74. As a result, a pilot pressure reduced in the arm proportional valve in accordance with the arm command signal is input to one of a pair of pilot ports of the arm control valve. As a result, since the hydraulic oil of the hydraulic pump is supplied to one of the head side chamber and the rod side chamber of the arm cylinder 8 corresponding to the arm command signal at a flow rate in accordance with the arm command signal, the arm 5 rotates in a direction in accordance with the arm command signal at a speed in accordance with the arm command signal.

When the bucket operation signal is input from the bucket operation device 23, the bucket travelling direction control unit 56 inputs a bucket command signal, which is a command signal corresponding to the bucket operation signal, to the bucket proportional valve corresponding to the operation direction of the bucket operation in the pair of bucket proportional valves 75 and 76. As a result, a pilot pressure reduced in the bucket proportional valve in accordance with the bucket command signal is input to one of a pair of pilot ports of the bucket control valve. As a result, since the hydraulic oil of the hydraulic pump is supplied to one of the head side chamber and the rod side chamber of the bucket cylinder 9 corresponding to the bucket command signal at a flow rate in accordance with the bucket command signal, the bucket 6 rotates in a direction in accordance with the bucket command signal at a speed in accordance with the bucket command signal.

On the other hand, in a case where the bucket travelling direction determination unit 55 determines that the excavation resistance acting on the bucket 6 needs to be reduced, the bucket travelling direction control unit 56 outputs a resistance reduction command signal, which is a command signal for operating the work device 3 so that the bucket 6 is displaced in the resistance reduction direction, which is a direction where the excavation resistance acting on the bucket 6 can be reduced, to the work device drive unit.

Figure 3:
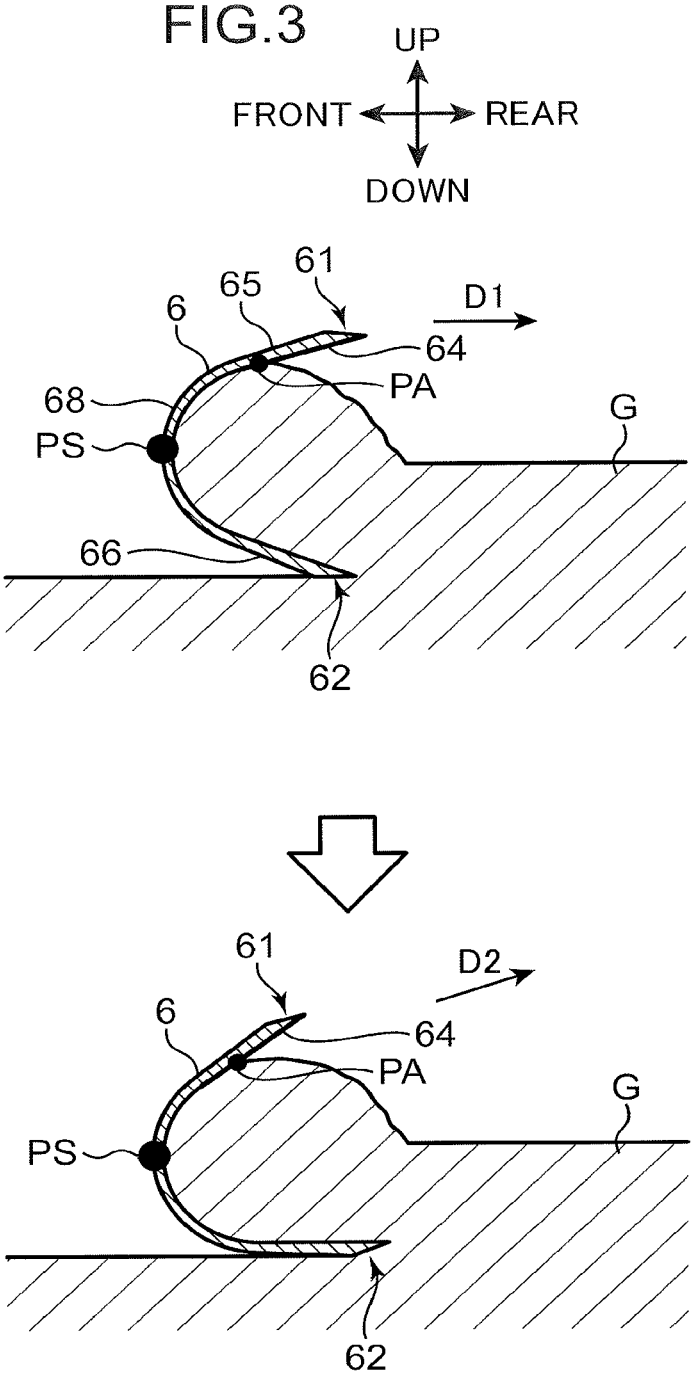
FIG. 3 is a cross-sectional view illustrating a bucket of the hydraulic excavator, and illustrates an example of a resistance reduction operation of the bucket.
Figure 4:
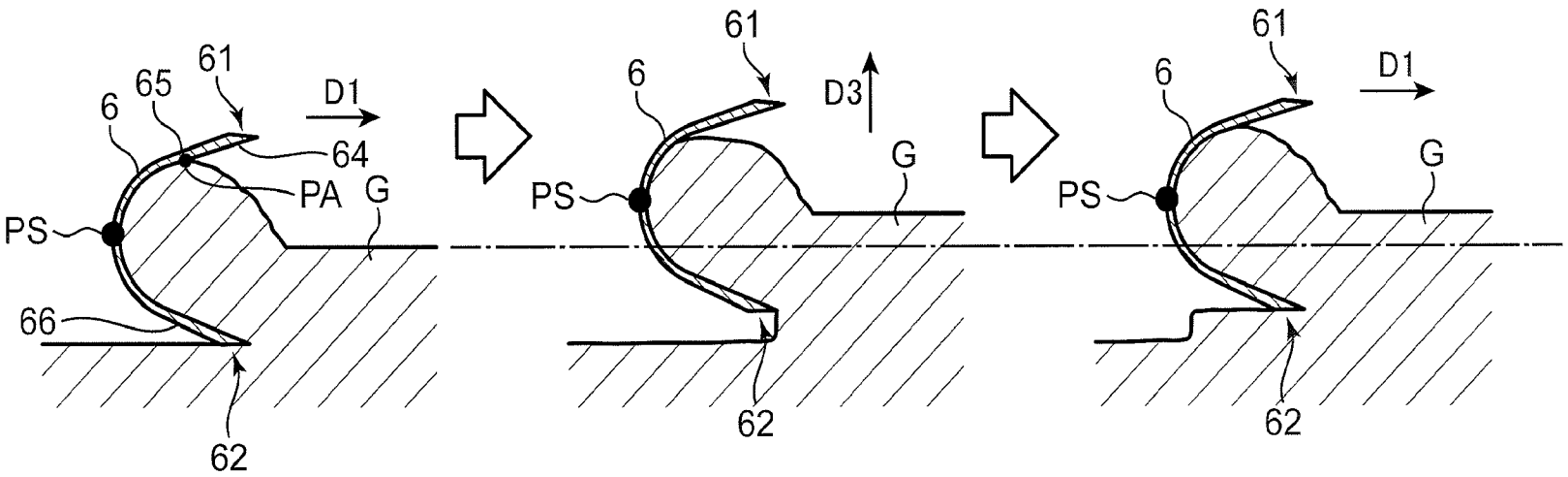
FIG. 4 is a cross-sectional view illustrating the bucket of the hydraulic excavator, and illustrates another example of the resistance reduction operation of the bucket.
Figure 5:
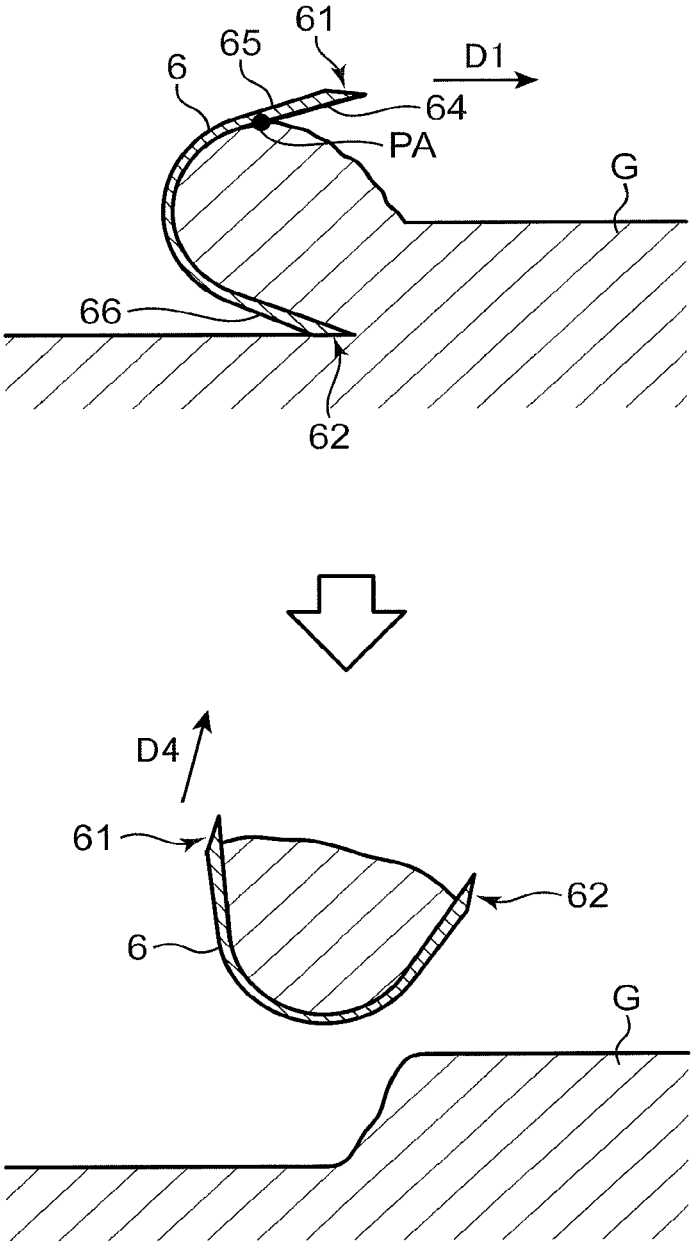
FIG. 5 is a cross-sectional view illustrating the bucket of the hydraulic excavator, and illustrates still another example of the resistance reduction operation of the bucket.

FIG. 3 illustrates an example of the resistance reduction operation of the bucket 6. FIG. 4 illustrates another example of the resistance reduction operation of the bucket 6. FIG. 5 illustrates still another example of the resistance reduction operation of the bucket 6. The resistance reduction operations illustrated in FIGS. 3, 4, and 5 are common in that the travelling direction of the bucket 6 is corrected to an upward direction. Note that the cross sections of the bucket 6 in FIGS. 3 to 5 are cross sections parallel to the vertical direction.

First, the resistance reduction operation illustrated in FIG. 3 will be described. The upper diagram of FIG. 3 illustrates a state where the bucket 6 is operated in a first direction D1, which is a direction close to the horizontal direction, for example, in the excavation work. In this state, in a case where the bucket travelling direction determination unit 55 determines that the excavation resistance acting on the bucket 6 needs to be reduced, the bucket travelling direction control unit 56 outputs a resistance reduction command signal, which is a command signal for operating the work device 3 so that the travelling direction of the bucket 6 is changed from the first direction D1 to a second direction D2, to the work device drive unit. The second direction D2 is an obliquely upward direction where the proportion of the upward component is increased with respect to the first direction D1.

In a case where the travelling direction of the bucket 6 is changed as illustrated in FIG. 3, in the present embodiment, the bucket travelling direction control unit 56 outputs the arm command signal corresponding to the arm operation signal as it is (outputs it without correction), and outputs resistance reduction command signals obtained respectively by correcting the boom command signal corresponding to the boom operation signal and the bucket command signal corresponding to the bucket operation signal. That is, in the present embodiment, in a case where the bucket travelling direction determination unit 55 determines that the excavation resistance acting on the bucket 6 needs to be reduced in the state illustrated in the upper diagram of FIG. 3, the bucket travelling direction control unit 56 outputs command signals to the plurality of proportional valves 71 to 76 so that the arm 5 performs the operation in accordance with the arm operation by the operator, the boom 4 operates in a direction where the proportion of the component in the boom raising direction is increased compared to the rotation operation in accordance with the boom operation by the operator instead of performing the rotation operation in accordance with the boom operation by the operator, and the bucket 6 operates in a direction where the proportion of the component in the bucket pulling direction is increased compared to the operation in accordance with the bucket operation by the operator instead of performing the operation in accordance with the bucket operation by the operator. As a result, since the travelling direction of the bucket 6 changes from the first direction D1 to the second direction D2, the excavation resistance acting on the bucket 6 can be reduced.

The resistance reduction operation illustrated in FIG. 4 will be then described. A left diagram of FIG. 4 illustrates a state where the bucket 6 is operated in the first direction D1, which is a direction close to the horizontal direction, for example, in the excavation work. In this state, in a case where the bucket travelling direction determination unit 55 determines that the excavation resistance acting on the bucket 6 needs to be reduced, the bucket travelling direction control unit 56 outputs a resistance reduction command signal, which is a command signal for operating the work device 3 so that the travelling direction of the bucket 6 is changed from the first direction D1 to a third direction D3, to the work device drive unit. The third direction D3 is a direction where the proportion of the upward component is increased with respect to the first direction D1, and an upward direction in a center diagram of FIG. 4.

In a case where the travelling direction of the bucket 6 in the left diagram of FIG. 4 is changed as illustrated in the center diagram of FIG. 4, in the present embodiment, the bucket travelling direction control unit 56 outputs the arm command signal corresponding to the arm operation signal and the bucket command signal corresponding to the bucket operation signal as they are (outputs them without correction), and outputs a resistance reduction command signal obtained by correcting the boom command signal corresponding to the boom operation signal. That is, in the present embodiment, in a case where the bucket travelling direction determination unit 55 determines that the excavation resistance acting on the bucket 6 needs to be reduced in the state illustrated in a left diagram of FIG. 4, the bucket travelling direction control unit 56 outputs command signals respectively to the plurality of proportional valves 71 to 76 so that the arm 5 and the bucket 6 perform the operations in accordance with the arm operation and the bucket operation by the operator, respectively, and the boom 4 operates in a direction where the proportion of the component in the boom raising direction is increased compared to the rotation operation in accordance with the boom operation by the operator instead of performing the rotation operation in accordance with the boom operation by the operator. As a result, since the travelling direction of the bucket 6 changes from the first direction D1 to the third direction D3, the excavation resistance acting on the bucket 6 can be reduced.

When a predetermined condition is satisfied, the bucket travelling direction control unit 56 outputs the boom command signal corresponding to the boom operation signal, the arm command signal corresponding to the arm operation signal, and the bucket command signal corresponding to the bucket operation signal as they are. As a result, since the boom 4, the arm 5, and the bucket 6 perform operations in accordance with the boom operation, the arm operation, and the bucket operation by the operator, respectively, the travelling direction of the bucket 6 changes from the third direction D3 to the first direction D1 or a direction close thereto as illustrated in a right diagram of FIG. 4. The predetermined condition may be, for example, that a predetermined time elapses from a time when the travelling direction of the bucket 6 changes from the first direction D1 to the third direction D3. In addition, as the predetermined condition, for example, a moving distance to the third direction D3 from the time when the travelling direction of the bucket 6 changes from the first direction D1 to the third direction D3 may reach a predetermined distance. In addition, as the predetermined condition, for example, a rotation angle of the boom 4 from the time when the travelling direction of the bucket 6 changes from the first direction D1 to the third direction D3 may reach a predetermined angle.

The resistance reduction operation illustrated in FIG. 5 will be then described. An upper diagram of FIG. 5 illustrates a state where the bucket 6 is operated in the first direction D1, which is a direction close to the horizontal direction, for example, in the excavation work. In this state, in a case where the bucket travelling direction determination unit 55 determines that the excavation resistance acting on the bucket 6 needs to be reduced, the bucket travelling direction control unit 56 outputs a resistance reduction command signal, which is a signal for operating the work device 3 so that the excavation work is completed, to the work device drive unit. Specifically, the bucket travelling direction control unit 56 outputs a resistance reduction command signal, which is a command signal for operating the work device 3 so that the travelling direction of the bucket 6 changes from the first direction D1 to a fourth direction D4, to the work device drive unit. The fourth direction D4 is a direction where the proportion of the upward component is increased with respect to the first direction D1, and is an upward direction or an obliquely upward direction away from the ground G in a lower diagram of FIG. 5.

In a case where the travelling direction of the bucket 6 illustrated in the upper diagram of FIG. 5 is changed as illustrated in a lower diagram of FIG. 5, in the present embodiment, the bucket travelling direction control unit 56 outputs resistance reduction command signals obtained respectively by correcting the boom command signal corresponding to the boom operation signal, the arm command signal corresponding to the arm operation signal, and the bucket command signal corresponding to the bucket operation signal. That is, in the present embodiment, in a case where the bucket travelling direction determination unit 55 determines that the excavation resistance acting on the bucket 6 needs to be reduced in the state illustrated in the upper diagram of FIG. 5, the bucket travelling direction control unit 56 outputs command signals respectively to the plurality of proportional valves 71 to 76 so that the bucket 6 moves in a direction away from the ground G instead of the rotation operations of the boom 4, the arm 5, and the bucket 6 in accordance with the boom operation, the arm operation, and the bucket operation by the operator. As a result, since the travelling direction of the bucket 6 changes from the first direction D1 to the fourth direction D4, the excavation resistance acting on the bucket 6 can be reduced.

Figure 6:
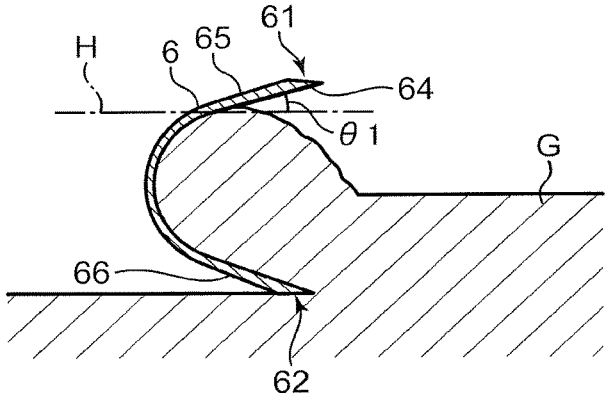
FIG. 6 is a cross-sectional view illustrating the bucket of the hydraulic excavator.

In the present embodiment, the bucket attitude calculation unit 51 includes a tilt calculation unit. As illustrated in FIG. 6, the tilt calculating unit calculates a tilt index value which is an index value corresponding to the tilt of the specific upper region 64 with respect to a predetermined reference plane H. In the present embodiment, the reference plane H is a horizontal plane, and the tilt index value is the angle θ1 of the upper plate 65 of the bucket 6 with respect to the reference plane H. In the present embodiment, since a part of the upper plate 65 has a flat plate shape (linear shape in the cross section of FIG. 6), an angle between the flat plate-shaped portion of the upper plate 65 and the reference plane H can be θ1. However, the entire upper plate 65 may be curved. In a case where the upper plate 65 has a curved shape, the tilt index value may be, for example, an angle between a tangent on a predetermined portion of the upper plate 65 and the reference plane H.

The work device control unit does not output the resistance reduction command signal in a case where the angle θ1 of the upper plate 65, the angle θ1 being calculated by the tilt calculation unit, is greater than a tilt threshold which is a predetermined threshold. The attitude of the bucket 6 in the excavation work has a high correlation with the magnitude of the excavation resistance in the excavation work. Specifically, for example, in a case where the tilt of the specific upper region 64 is great with respect to the horizontal plane H, the excavation resistance tends to decrease, and in a case where the tilt of the specific upper region 64 is small with respect to the horizontal plane H, the excavation resistance tends to increase. Therefore, in a case where the angle θ1 of the upper plate 65 is greater than the tilt threshold, the excavation resistance is likely not to need to be decreased in the excavation work, and in this case, the resistance reduction command signal is not output. As a result, the processing load of the controller 50 can be reduced.

Figure 7:
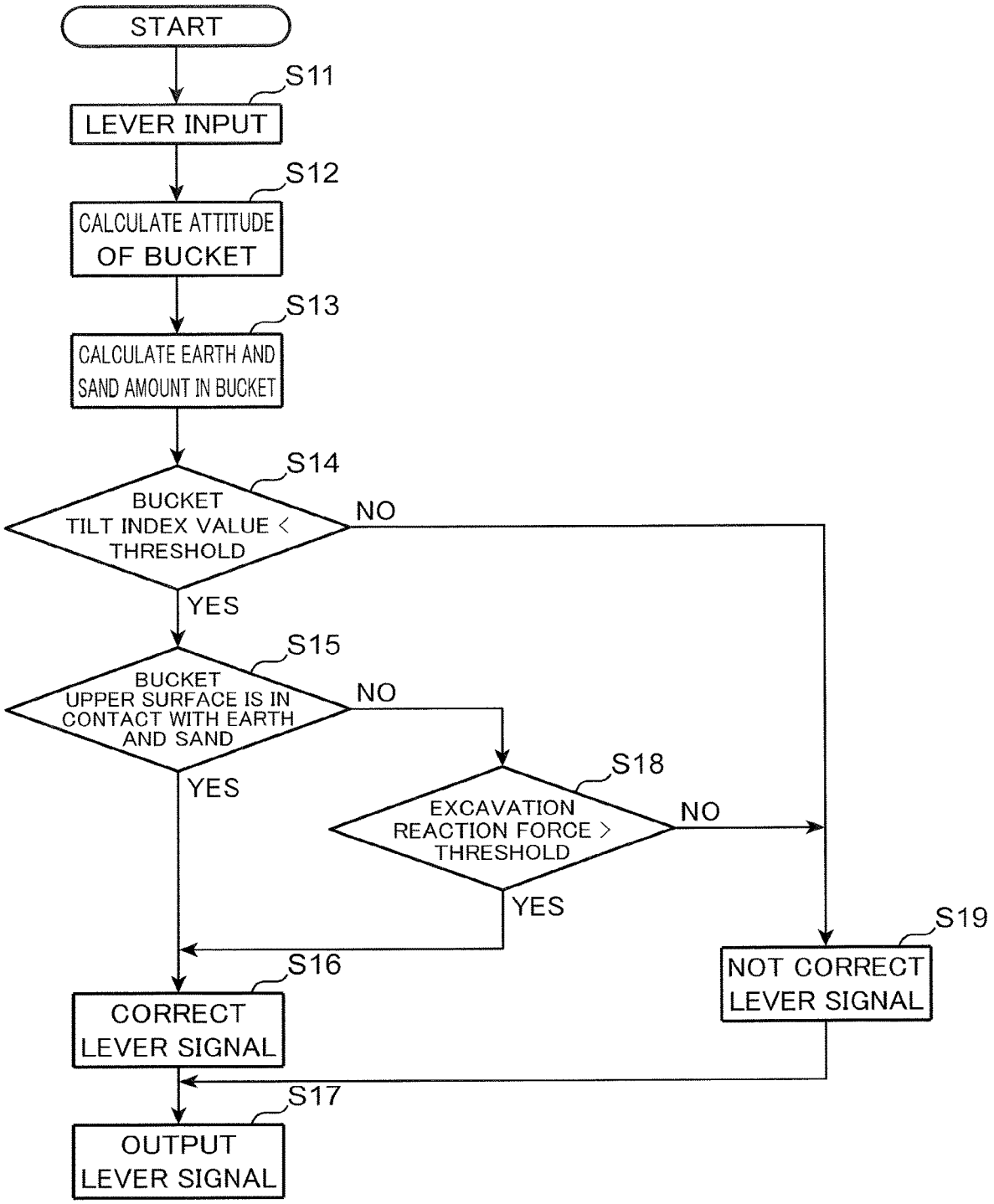
FIG. 7 is a flowchart illustrating a calculation control operation of the controller.

FIG. 7 is a flowchart illustrating a calculation control operation of the controller 50. The controller 50 receives lever signals from the plurality of operation devices 21 to 23 (step S11). Further, the controller 50 receives inputs of earth and sand information from the image acquisition sensor 80, pressure detection signals from the plurality of cylinder pressure sensors 35, and attitude detection signals from the angle sensor 31 to 34.

Specifically, the bucket attitude calculation unit 51 calculates the bucket attitude based on a boom attitude detection signal, an arm attitude detection signal, and a bucket attitude detection signal (step S12). Further, the tilt calculation unit of the bucket attitude calculation unit 51 calculates the angle θ1 of the upper plate 65 of the bucket 6 with respect to the reference plane H based on the boom attitude detection signal, the arm attitude detection signal, and the bucket attitude detection signal (step S12).

The earth and sand amount calculation unit 52 calculates an accumulation state of the earth and sand in the accommodation space of the bucket 6 using the bucket attitude and the earth and sand information (step S13).

Next, the bucket travelling direction determination unit 55 determines whether the angle θ1 of the upper plate 65 of the bucket 6 is smaller than a tilt threshold which is a predetermined threshold (step S14).

In a case where the angle θ1 of the upper plate 65 is equal to or larger than the tilt threshold (NO in step S14), the bucket travelling direction determination unit 55 determines that the excavation resistance acting on the bucket 6 does not need to be reduced, and the bucket travelling direction control unit 56 does not correct the command signals corresponding to the boom operation signal, the arm operation signal, and the bucket operation signal (step S19). In this case, the bucket travelling direction control unit 56 outputs the command signals corresponding to the boom operation signal, the arm operation signal, and the bucket operation signal to the work device drive unit (step S17).

On the other hand, in a case where the angle 1 of the upper plate 65 is smaller than the tilt threshold (YES in step S14), the contact state determination unit 53 determines the contact state based on the accumulation state calculated by the earth and sand amount calculation unit 52 (step S15).

Specifically, in step S13, the earth and sand amount calculation unit 52 (accumulation state calculation unit) can calculate the accumulation state of the earth and sand in the accommodation space of the bucket 6, for example, as follows using the bucket attitude and the earth and sand information. That is, the earth and sand amount calculation unit 52 compares information (initial image information) related to the initial image which is the image in the bucket 6 in a non-accommodation state where no object such as earth and sand is accommodated in the accommodation space of the bucket 6 with information (image information during excavation) related to the image in the bucket 6 acquired by the image acquisition sensor 80 such as the LiDAR during the excavation work, and thus can calculate a position of a portion PA (an intersection PA in the cross-sectional view of FIG. 3) where the inner surface of the bucket 6 intersects the upper surface of the earth and sand as illustrated in FIG. 3, for example. For example, the earth and sand amount calculation unit 52 converts the initial image information correspondingly to the bucket attitude at the time of acquisition of the image information during excavation, and thus can compare the initial image information with the image information during excavation. Then, the contact state determination unit 53 determines whether the calculated portion PA is within the range of the specific upper region 64 on the inner surface of the bucket 6, and thus can determine the contact state. The initial image information may be stored in advance in the memory of the controller 50. In addition, the initial image information may be acquired by the image acquisition sensor 80 before the start of the excavation work or at the start time.

Note that the earth and sand amount calculation unit 52 may calculate the position of the portion PA where the inner surface of the bucket 6 intersects the upper surface of the earth and sand at a predetermined specific widthwise position such as the center of the inner surface of the bucket 6 in the widthwise direction, for example. Further, the distance measuring sensor such as the LiDAR can acquire data corresponding to the portion PA where the inner surface of the bucket 6 intersects the upper surface of the earth and sand at a plurality of the widthwise positions. In this case, the contact state determination unit 53 may calculate an average value of the positions of the portion PA where the inner surface of the bucket 6 intersects the upper surface of the earth and sand at the plurality of widthwise positions, and determine the contact state using the average value. Further, the contact state determination unit 53 may calculate a minimum value or a maximum value of the positions of the portion PA where the inner surface of the bucket 6 intersects the upper surface of the earth and sand at the plurality of widthwise positions, and determine the contact state using the minimum value or the maximum value.

In a case where the contact state determination unit 53 determines that the earth and sand is in contact with the specific upper region 64 (the upper surface of the bucket 6) of the bucket 6 (YES in step S15), the bucket travelling direction determination unit 55 determines that the excavation resistance acting on the bucket 6 needs to be reduced, and the bucket travelling direction control unit 56 corrects at least one of the command signals corresponding to the boom operation signal, the arm operation signal, and the bucket operation signal (step S16).

The command signal may be corrected in accordance with a movement pattern (target route) of the bucket 6 set in advance correspondingly to the resistance reduction operation performed by the bucket 6. For example, the hydraulic excavator 10 may include an input device for the operator to select the resistance reduction operation to be performed by the bucket 6 in the excavation work among the resistance reduction operations in FIGS. 3, 4, and 5 at the start of the excavation work. In this case, in step S16, the bucket travelling direction control unit 56 corrects at least one of the command signals corresponding to the boom operation signal, the arm operation signal, and the bucket operation signal so that the bucket 6 is displaced along the predetermined movement pattern correspondingly to the resistance reduction operation selected by the operator (step S16), and outputs the command signals including the resistance reduction command signal which is the corrected command signal respectively to the plurality of proportional valves 71 to 76 (step S17). As a result, the bucket 6 is displaced in the resistance reduction direction which is a direction where the excavation resistance acting on the bucket 6 can be reduced.

On the other hand, in a case where the contact state determination unit 53 determines that the earth and sand is not in contact with the specific upper region 64 of the bucket 6 (NO in step S15), the excavation reaction force calculation unit 54 calculates the excavation reaction force based on the detection signal input from the machine body tilt angle sensor 34, the detection signals input from the boom angle sensor 31, the arm angle sensor 32, and the bucket angle sensor 33, the pressure detection signals input from the plurality of cylinder pressure sensors 35, and the dimension information regarding the dimension between the links in the work device 3, and the bucket travelling direction determination unit 55 determines whether the calculated excavation reaction force is greater than a reaction force threshold which is a predetermined threshold (step S18).

In a case where the excavation reaction force is greater than the reaction force threshold (YES in step S18), the bucket travelling direction determination unit 55 determines that the excavation resistance acting on the bucket 6 needs to be reduced, and the bucket travelling direction control unit 56 corrects at least one of the command signals corresponding to the boom operation signal, the arm operation signal, and the bucket operation signal (step S16), and outputs the command signals including the resistance reduction command signal which is the corrected command signal respectively to the plurality of proportional valves 71 to 76 (step S17). As a result, the bucket 6 is displaced in the resistance reduction direction which is a direction where the excavation resistance acting on the bucket 6 can be reduced.

On the other hand, in a case where the excavation reaction force is equal to or smaller than the reaction force threshold (NO in step S18), the bucket travelling direction determination unit 55 determines that the excavation resistance acting on the bucket 6 does not need to be reduced, and the bucket travelling direction control unit 56 does not correct the command signals corresponding to the boom operation signal, the arm operation signal, and the bucket operation signal (step S19). In this case, the bucket travelling direction control unit 56 outputs the command signals corresponding to the boom operation signal, the arm operation signal, and the bucket operation signal to the work device drive unit (step S17).

Figure 8:
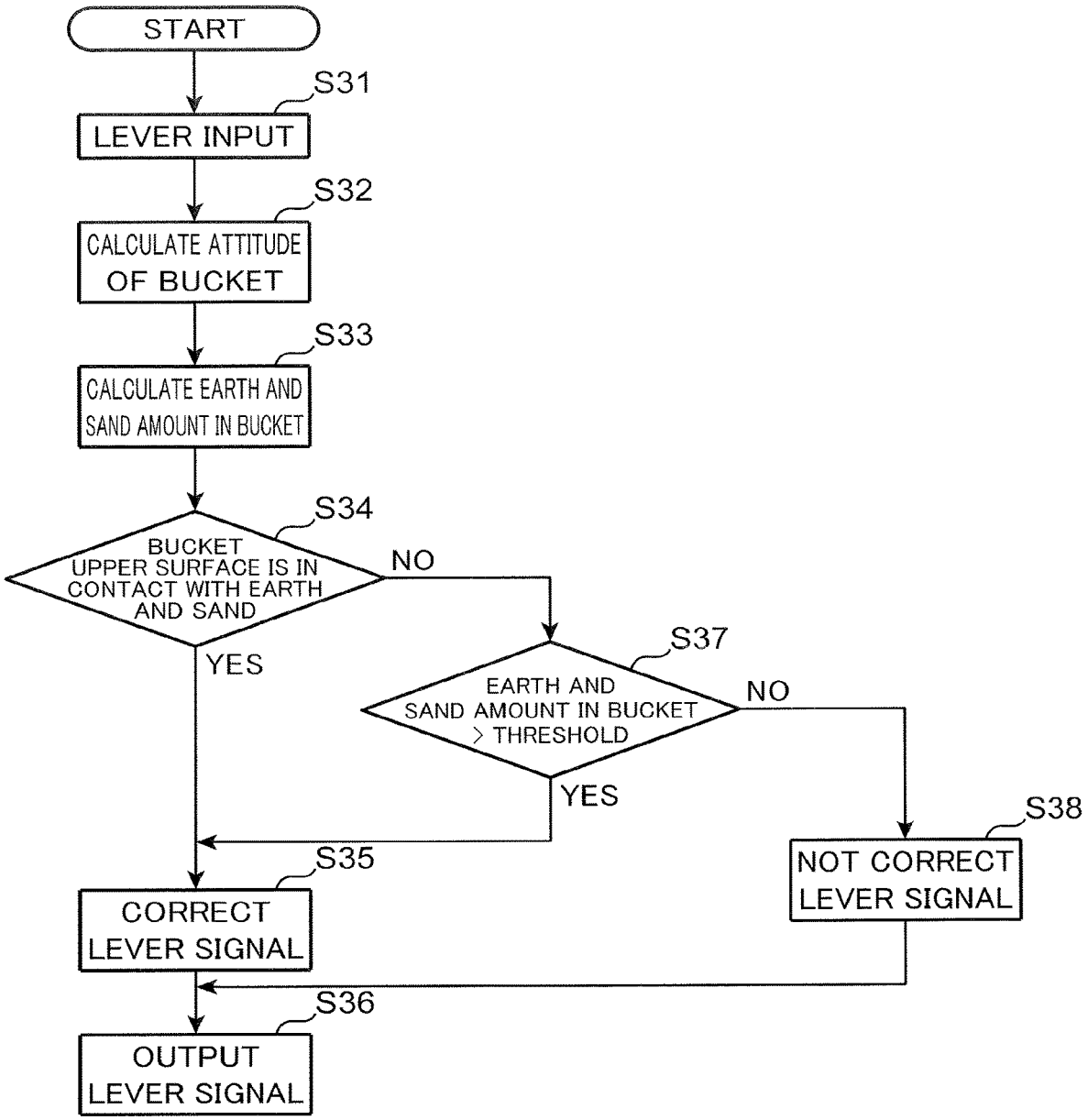
FIG. 8 is a flowchart illustrating a calculation control operation of the controller.

FIG. 8 is a flowchart illustrating another example of the calculation control operation of the controller 50. Since the processing in steps S31 to S33 in FIG. 8 is similar to the processing in steps S11 to S13 in FIG. 7, and the processing in steps S34 to S36 and S38 in FIG. 8 is similar to the processing in steps S15 to S17 and S19 in FIG. 7, detailed description of these processing is omitted. Further, in the calculation control operation illustrated in FIG. 8, the processing in steps S14 and S18 in FIG. 7 is omitted, and the processing in step S37 is included. Therefore, a content related to step S37 will be mainly described below.

In the calculation control operation illustrated in FIG. 8, in a case where the contact state determination unit 53 determines that the earth and sand is not in contact with the specific upper region 64 (the upper surface of the bucket 6) of the bucket 6 (NO in step S34), the bucket travelling direction determination unit 55 determines whether the amount of the earth and sand in the bucket 6 is greater than an earth and sand amount threshold which is a predetermined threshold (step S37). The bucket travelling direction determination unit 55 can determine (calculate) the amount of the earth and sand in the bucket 6 based on, for example, the intersecting portion PA (the intersection PA) calculated by the earth and sand amount calculation unit 52. Specifically, for example, the controller 50 stores in advance a map indicating a relationship between the position of the intersecting portion PA (the intersection PA) and the amount of the earth and sand in the bucket 6, and the bucket travelling direction determination unit 55 can calculate the amount of the earth and sand in the bucket 6 based on the intersecting portion PA (the intersection PA) calculated by the earth and sand amount calculation unit 52 and the map. For example, the earth and sand amount threshold may be set to a value such that consumption of wasteful energy can be prevented while a significant decrease in the amount of the earth and sand in the bucket with respect to the capacity of the bucket at the completion of excavation is being prevented.

In a case where the earth and sand amount is greater than the earth and sand amount threshold (YES in step S37), the bucket travelling direction determination unit 55 determines that the excavation resistance acting on the bucket 6 needs to be reduced, and the bucket travelling direction control unit 56 corrects at least one of the command signals corresponding to the boom operation signal, the arm operation signal, and the bucket operation signal (step S35), and outputs the command signals including the resistance reduction command signal which is the corrected command signal respectively to the plurality of proportional valves 71 to 76 (step S36). As a result, the bucket 6 is displaced in the resistance reduction direction which is a direction where the excavation resistance acting on the bucket 6 can be reduced.

On the other hand, in a case where the earth and sand amount is equal to or smaller than the earth and sand amount threshold (NO in step S37), the bucket travelling direction determination unit 55 determines that the excavation resistance acting on the bucket 6 does not need to be reduced, and the bucket travelling direction control unit 56 does not correct the command signals corresponding to the boom operation signal, the arm operation signal, and the bucket operation signal (step S38). In this case, the bucket travelling direction control unit 56 outputs the command signals corresponding to the boom operation signal, the arm operation signal, and the bucket operation signal to the work device drive unit (step S36).

Figure 9:
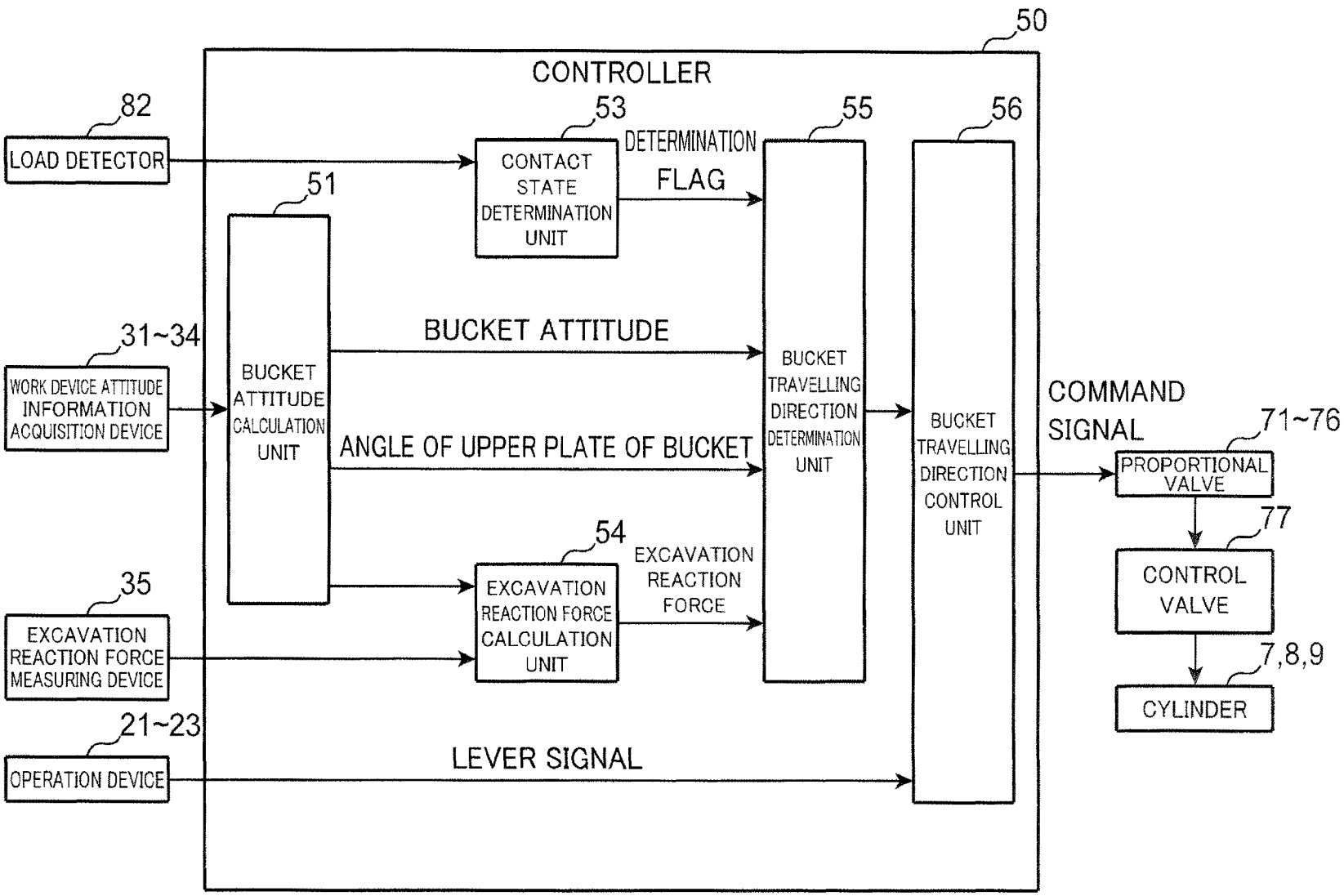
FIG. 9 is a block diagram illustrating a functional configuration of the controller of the hydraulic excavator according to a modification of the embodiment and input and output signals thereof.

FIG. 9 is a block diagram illustrating a functional configuration of the controller 50 of the hydraulic excavator 10 according to a modification of the present embodiment and input and output signals thereof. The hydraulic excavator 10 according to this modification includes a load detector 82 instead of the image acquisition sensor 80 in the block diagram illustrated in FIG. 2. The load detector 82 is another example of an earth and sand information acquisition device that acquires earth and sand information that is information regarding earth and sand accommodated in the accommodation space of the bucket 6.

The load detector 82 is a sensor that is disposed on the specific upper region 64 of the inner surface of the bucket 6 and is capable of detecting an earth and sand load that is a load received from the earth and sand accommodated in the accommodation space of the bucket 6. Specifically, the load detector 82 is attached to at least a portion of the specific upper region 64. As the load detector 82, for example, a strain meter, a pressure-sensitive sensor, a load cell, or the like can be used. The load detector 82 inputs a load detection signal, which is a detection signal corresponding to the detected earth and sand load, to controller 50.

The contact state determination unit 53 determines the contact state between the specific upper region 64 and the earth and sand based on the earth and sand load detected by the load detector 82. Specifically, for example, in a case where the earth and sand load detected by the load detector 82 is equal to or greater than a load threshold which is a predetermined threshold, the contact state determination unit 53 may determine that the earth and sand is in contact with the specific upper region. In this modification, since the contact state between the specific upper region 64 and the earth and sand is determined based on the earth and sand load detected by the load detector 82, an increase in the processing load of the controller 50 can be prevented as compared with the case where the contact state is determined based on the image processing data (point cloud data) by the image acquisition sensor 80 such as the LiDAR in the block diagram illustrated in FIG. 2, for example.

As described above, in the hydraulic excavator 10 according to the present embodiment, since the determination as to whether to perform the control for reducing the excavation resistance in the excavation work is made in accordance with the contact state between the specific upper region 64 on the inner surface of the bucket 6 and the earth and sand, degradation in the efficiency of the excavation work can be prevented while an increase in the excavation resistance in the excavation work is being prevented.

In a case where the earth and sand information acquisition device is a sensor (for example, a sensor such as the load detector 82 described above) that directly detects a load applied from the earth and sand in contact with the inner surface of the bucket 6, the contact state determination unit 53 can directly determine the contact state between the specific upper region 64 and the earth and sand based on a detection signal input from the sensor to the controller 50. Furthermore, in a case where the earth and sand information acquisition device is, for example, a sensor such as the above-described image acquisition sensor 80, the contact state determination unit 53 can indirectly determine the contact state between the specific upper region 64 and the earth and sand (estimate the contact state) based on the earth and sand information such as image information input from the sensor to the controller 50.

In the present embodiment, the work device control unit outputs the resistance reduction command signal in a case where the contact state determination unit 53 determines that the earth and sand is in contact with the specific upper region 64 of the bucket 6, and displaces the bucket 6 in the resistance reduction direction to reduce the excavation resistance. Thus, the amount of the earth and sand in the bucket 6 can be sufficiently secured in the excavation work.

In the present embodiment, the work device control unit outputs the resistance reduction command signal in a case where the contact state determination unit 53 determines that the earth and sand is not in contact with the specific upper region 64 of the bucket 6 and the amount of the earth and sand accommodated in the accommodation space of the bucket 6 is greater than the earth and sand amount threshold which is a predetermined threshold. In a case where the amount of the earth and sand in the bucket 6 is greater than the earth and sand amount threshold even if the earth and sand in the bucket 6 is not in contact with the specific upper region 64 in the excavation work, the resistance reduction command signal is output. Therefore, the bucket 6 can be displaced in the resistance reduction direction so that the excavation resistance can be reduced before the earth and sand in the bucket 6 contacts the specific upper region 64 and thus the excavation resistance increases. Accordingly, wasteful energy consumption can be prevented.

In the present embodiment, in a case where the contact state determination unit determines that the earth and sand is not in contact with the specific upper region 64 of the bucket 6 and the excavation reaction force is greater than the reaction force threshold, the work device control unit outputs the resistance reduction command signal. In the present embodiment, the reaction force threshold is set to a value such that a significant reduction in the operation speed of the bucket 6 due to an increase in the excavation reaction force can be prevented. When the operation speed of the bucket 6 greatly reduces, the efficiency of the excavation work is degraded. In the present embodiment, in a case where the excavation reaction force is greater than the reaction force threshold even when the earth and sand in the bucket 6 is not in contact with the specific upper region 64, the bucket 6 is displaced in the resistance reduction direction so that the excavation resistance is decreased. Therefore, the degradation in the efficiency of the excavation work can be further prevented.

In the present embodiment, the contact state determination unit 53 determines the contact state between the specific upper region 64 and the earth and sand based on the accumulation state calculated by the earth and sand amount calculation unit 52 which is an example of the accumulation state calculation unit. That is, in the present embodiment, the contact state between the specific upper region 64 and the earth and sand can be determined based on the actual accumulation state of the earth and sand in the bucket 6.

In a modification of the present embodiment, since the contact state determination unit 53 determines the contact state between the specific upper region 64 and the earth and sand based on the earth and sand load detected by the load detector 82, an increase in the processing load of the controller 50 can be prevented as compared with, for example, the case of determining the contact state based on the image processing data.

In the present embodiment, the work device control unit does not output the resistance reduction command signal in a case where the tilt index value calculated by the tilt calculation unit of the bucket attitude calculation unit 51 is greater than a tilt threshold. In a case where the tilt index value is greater than the tilt threshold, the excavation resistance is likely not to need to be reduced in the excavation work, and in this case, the resistance reduction command signal is not output. As a result, the processing load of the controller 50 can be reduced.

MODIFICATIONS

The construction machine according to the embodiment of the present disclosure has been described above, but the present disclosure is not limited to the embodiment, and includes the following modifications, for example.

(A) Operation Devices

In the above embodiment, each of the plurality of operation devices (operation devices 21, 22, and 23) is configured by an electric lever device, but the present disclosure is not limited to such a mode. Each of the plurality of operation devices may be an operation device including an operation lever and a remote control valve. In this case, the remote control valve of each of the plurality of operation devices is interposed between a pilot pump, not illustrated, and the pair of pilot ports of the control valve corresponding to the remote control valve. The remote control valve operates to supply a pilot pressure in accordance with an operation amount of the operation lever to the pilot port corresponding to an operation direction of the operation lever. As a result, a flow rate and a supply direction of hydraulic oil supplied to a cylinder corresponding to the operation device are adjusted. In this case, each of the proportional valves 71 to 76 may be disposed so as to be interposed between the remote control valve corresponding to the proportional valve and the pilot port of the control valve.

(B) Work Device Attitude Information Acquisition Device

The work device attitude information acquisition device may be, for example, a plurality of stroke sensors. The plurality of stroke sensors include a boom cylinder stroke sensor that detects a cylinder length of the boom cylinder 7, an arm cylinder stroke sensor that detects a cylinder length of the arm cylinder 8, and a bucket cylinder stroke sensor that detects a cylinder length of the bucket cylinder 9. Each of the plurality of stroke sensors inputs a detection signal corresponding to the detected cylinder length to the controller 50. The controller 50 stores in advance dimensional information about dimensions between links in the work device 3, dimensional information about attachment positions of the cylinders, and the like. The dimensions between the links include, for example, the distance between the horizontal axis A1 and the horizontal axis A2, and the distance between the horizontal axis A2 and the horizontal axis A3. Based on the cylinder lengths of the plurality of stroke sensors and the dimensional information, a relative angle between the machine body and the boom 4, a relative angle between the boom 4 and the arm 5, a relative angle between the arm 5 and the bucket 6, the attitude of the work device 3, and the like can be geometrically calculated. Therefore, the bucket attitude calculation unit 51 can geometrically calculate the attitude of the bucket 6 based on the detection signals input from the plurality of stroke sensors and the dimension information.

(C) The construction machine of the present disclosure is also applicable to, for example, (1) a case where machine control for supporting an operator in excavation work is performed, (2) a case where the operator remotely operates the excavation work by the hydraulic excavator 10, (3) a case where the hydraulic excavator 10 is automatically operated (for example, fully automatically operated), and the like.

(1) Machine Control

In a case where the machine control is performed in a manner that the controller 50 automatically controls the operation of the work device 3 so that the bucket 6 is displaced along a target excavation surface of the bucket 6 in the excavation work, the target excavation surface being stored in advance in the memory of the controller 50, the at least one operation device for causing the work device to perform the excavation work may be an operation device such as an operation switch that is disposed in a cabin and enables the operator to perform an input operation, or may be any operation device (for example, the arm operation device) among the plurality of operation devices. In this case, when an input operation is input from the operator to the operation device, the controller 50 operates the machine control for operating the work device 3 so that the excavation work of excavating the ground of the work site into a shape corresponding to the target excavation surface is performed. In the excavation work in the machine control, the work device control unit outputs a resistance reduction command signal for operating the work device so that the bucket is displaced in the resistance reduction direction in accordance with a determination result from the contact state determination unit.

Since the actual site situation includes various situations that cannot be kept track of by a person in charge of the work before the work, the efficient excavation work cannot be necessarily performed only by the controller 50 automatically controlling the operation of the work device 3 such that the bucket 6 is displaced along the target excavation surface stored in advance in the machine control as described above. Even in such a case, the work device control unit performs control such that the resistance reduction command signal is output in accordance with the determination result from the contact state determination unit. Thus, the bucket 6 can be operated to match the actual site situation, and the efficient excavation work can be performed.

(2) Remote Operation

In a case where the operator remotely operates the excavation work by the hydraulic excavator 10, the construction machine includes a construction machine body configured by the hydraulic excavator 10 and a remote operation device disposed at a remote place away from the hydraulic excavator 10. The remote operation device includes a boom remote operation device, an arm remote operation device, and a bucket remote operation device, which are not illustrated, corresponding to the boom operation device 21, the arm operation device 22, and the bucket operation device 23, respectively, in the cabin of the hydraulic excavator 10. When the operator operates the operation levers of the boom remote operation device, the arm remote operation device, and the bucket remote operation device, operation signals corresponding thereto are input to the controller 50 of the hydraulic excavator 10 via wireless or wired communication, and the work device 3 performs operations corresponding to the operation signals. In this case, at least one operation device for operating the work device to perform excavation work includes the boom remote operation device, the arm remote operation device, and the bucket remote operation device. In the excavation work in this remote operation, the work device control unit outputs a resistance reduction command signal for operating the work device so that the bucket is displaced in the resistance reduction direction in accordance with a determination result from the contact state determination unit. In addition, in this remote operation, the above-described machine control may be performed. In this case, the at least one operation device for operating the work device to perform the excavation work may be an operation device such as an operation switch that is disposed at a remote place and enables an operator to perform an input operation, or may be an operation device of any one of the boom remote operation device, the arm remote operation device, and the bucket remote operation device that are disposed at a remote place.

In the remote control described above, since the operator operates the hydraulic excavator 10 while viewing the monitor at a remote place, the operator has difficulty in keeping track of details of the actual site situation, and thus the operator cannot necessarily perform efficient excavation work. Even in such a case, the work device control unit performs control such that the resistance reduction command signal is output in accordance with the determination result from the contact state determination unit. Thus, the bucket 6 can be operated to match the actual site situation, and the efficient excavation work can be performed.

(3) Automatic Operation

In a case where the automatic operation is performed in a manner that the controller 50 automatically controls the operation of the work device 3 so that the bucket 6 is displaced along a target route of the bucket 6 in the excavation work, the target route being stored in advance in the memory of the controller 50, at least one operation device for operating the work device to perform the excavation work may be, for example, an information terminal on which an operator can perform an input operation. Such an information terminal may be, for example, a personal computer, a portable information terminal such as a tablet, or another information terminal. When the operator performs an input operation on the information terminal, the information terminal outputs a start command which is a command for causing the controller 50 to start the automatic operation of the hydraulic excavator 10, and the output start command is input to the controller 50 via wireless or wired communication. The operator may perform the input operation on the information terminal outside the hydraulic excavator 10 or may perform the input operation on the information terminal inside the cabin of the hydraulic excavator 10. In this excavation work in the automatic operation (for example, fully automatic operation), the work device control unit outputs the resistance reduction command signal for operating the work device so that the bucket is displaced in the resistance reduction direction in accordance with a determination result from the contact state determination unit.

The automatic operation will be described more specifically as follows. In this automatic operation, the controller 50 determines, for example, whether the teeth of the bucket 6 have reached the excavation start position. When detecting that the teeth have reached the excavation start position, the controller 50 starts the excavation work. In this excavation work, the work device control unit outputs a target corresponding command signal which is a command signal corresponding to the target route to control the operation of the work device 3. However, for example, in a case where the contact state determination unit 53 determines that the earth and sand is in contact with the specific upper region 64 of the bucket 6, the work device control unit outputs a resistance reduction command signal (a signal obtained by correcting the target corresponding command signal) for operating the work device so that the bucket is displaced in the resistance reduction direction.

Since the actual site situation includes various situations that cannot be kept track of by a person in charge of the work before the work, in the automatic operation, the efficient excavation work cannot be necessarily performed only by the controller 50 automatically controlling the operation of the work device 3 such that the bucket 6 is displaced along the target route of the bucket 6 in the excavation work, the target route being stored in advance. Even in such a case, the work device control unit performs control such that the resistance reduction command signal is output in accordance with the determination result from the contact state determination unit. Thus, the bucket 6 can be operated to match the actual site situation, and the efficient excavation work can be performed.

(D) Accommodation State Determination Unit

In the above embodiment, the accommodation state determination unit is the contact state determination unit 53 that determines the contact state between the specific upper region 64 and the earth and sand, and the work device control unit outputs the resistance reduction command signal in accordance with the determination result from the contact state determination unit 53. However, the accommodation state determination unit only needs to be able to determine the accommodation state of the earth and sand accommodated in the bucket in the excavation work, and does not necessarily need to determine the contact state between the specific upper region 64 and the earth and sand as in the above-described embodiment. In this case, the work device control unit outputs the resistance reduction command signal in accordance with the determination result from the accommodation state determination unit.

Specifically, the accommodation state determination unit may be, for example, an earth and sand amount determination unit that determines that a predetermined amount of earth and sand has entered the bucket in the excavation work. In this case, the work device control unit outputs the resistance reduction command signal in accordance with a determination result from the earth and sand amount determination unit. For example, the earth and sand amount determination unit may determine whether a predetermined amount of earth and sand has entered the bucket, based on a detection signal input to the controller 50 from a sensor capable of detecting the amount of the earth and sand (a volume or weight of the earth and sand) in the bucket. In a case where the earth and sand amount calculation unit 52

(the accumulation state calculation unit) compares the initial image information with the image information during excavation to calculate the earth and sand amount (for example, the volume of the earth and sand) in the bucket, the earth and sand amount determination unit may determine whether a predetermined amount of earth and sand has entered the bucket, based on the amount of the earth and sand in the bucket, the amount being calculated by the earth and sand amount calculation unit 52.

As described above, the present disclosure provides the construction machine capable of preventing degradation in the efficiency of the excavation work while preventing an increase in the excavation resistance in the excavation work.

Provided is a construction machine including: a machine body; a work device including a boom supported to the machine body to be capable of being raised and lowered, an arm rotatably supported to the boom, and a bucket supported to the arm, the bucket having a bucket base end portion that is a base end portion rotatably attached to the arm, a bucket tip portion that is a tip portion on an opposite side of the bucket base end portion, and an inner surface defining an accommodation space that is a space capable of accommodating earth and sand; at least one operation device that causes the work device to perform excavation work so that earth and sand on a ground is excavated by displacing the bucket with respect to the ground while maintaining a state where a portion including at least the bucket tip portion is in contact with the ground at an excavation attitude that is a bucket attitude at which the bucket base end portion is disposed at a position higher than the bucket tip portion and is an attitude at which the earth and sand on the ground is capable of being excavated; and a controller, in which the controller includes an accommodation state determination unit that determines an accommodation state of earth and sand accommodated in the bucket; and a work device control unit that outputs a resistance reduction command signal that is a command signal for operating the work device so that the bucket is displaced in a resistance reduction direction that is a direction where an excavation resistance acting on the bucket is capable of be reduced, in accordance with a determination result from the accommodation state determination unit.

In this construction machine, since the determination as to whether to perform the control for reducing the excavation resistance in the excavation work is made in accordance with the accommodation state of the earth and sand accommodated in the bucket, the degradation in the efficiency of the excavation work can be prevented while the increase in the excavation resistance in the excavation work is reduced. Specifically, when the amount of the earth and sand in the bucket increases, the excavation resistance in the excavation work tends to increase. Therefore, the accommodation state of the earth and sand accommodated in the bucket has a high correlation with the magnitude of the excavation resistance in the excavation work. Therefore, the accommodation state of the earth and sand accommodated in the bucket can be an index for determining whether to control the reduction of the excavation resistance in excavation work. In this construction machine, since the determination as to whether to control the reduction of the excavation resistance in the excavation work is made in accordance with the accommodation state of the earth and sand accommodated in the bucket, when the amount of the earth and sand in the bucket increases and thus the excavation resistance increases or the excavation resistance tends to increase, the bucket can be displaced in the resistance reduction direction to reduce the excavation resistance. Further, even if the excavation resistance does not increase in the excavation work, when the amount of the earth and sand in the bucket increases, the bucket is displaced in the resistance reduction direction to further decrease the excavation resistance. Thus, wasteful energy consumption can be prevented. This makes it possible to prevent the degradation in efficiency of the excavation work while preventing the increase in the excavation resistance in the excavation work.

It is preferable that the accommodation state determination unit is the contact state determination unit that determines a contact state between a specific upper region and the earth and sand, the specific upper region being a portion located at an upper portion on the inner surface of the bucket at the excavation attitude, and the work device control unit outputs the resistance reduction command signal in accordance with a determination result from the contact state determination unit. In this configuration, the determination of the accommodation state of the earth and sand accommodated in the bucket is made using the determination of the contact state between the specific upper region on the inner surface of the bucket and the earth and sand. That is, in this configuration, the determination as to whether to control the reduction of the excavation resistance in the excavation work is made in accordance with the contact state between the specific upper region and the earth and sand. This makes it possible to prevent the degradation in efficiency of the excavation work while preventing the increase in the excavation resistance in the excavation work. Specifically, the specific upper region, which is a portion on the inner surface of the bucket, the portion being located at the upper portion at the excavation attitude, does not come into contact with the earth and sand when the amount of the earth and sand in the bucket is small in the excavation work, but comes into contact with the earth and sand when the amount of the earth and sand in the bucket increases in the excavation work. In addition, as described above, when the amount of the earth and sand in the bucket increases, the excavation resistance in the excavation work tends to increase. Therefore, the contact state between the specific upper region and the earth and sand has a high correlation with the magnitude of the excavation resistance in the excavation work. Therefore, the contact state between the specific upper region and the earth and sand can be an index for determining whether to control the reduction in the excavation resistance in the excavation work. In this construction machine, since the determination as to whether to control the reduction in the excavation resistance in the excavation work is made in accordance with the contact state between the specific upper region and the earth and sand, when the amount of the earth and sand in the bucket increases and thus the excavation resistance increases or the excavation resistance tends to increase, the bucket can be displaced in the resistance reduction direction to reduce the excavation resistance. Further, even if the excavation resistance does not increase in the excavation work, when the amount of the earth and sand in the bucket increases, the bucket is displaced in the resistance reduction direction to further decrease the excavation resistance. Thus, wasteful energy consumption can be prevented. This makes it possible to prevent the degradation in efficiency of the excavation work while preventing the increase in the excavation resistance in the excavation work.

The work device control unit preferably outputs the resistance reduction command signal in a case where the contact state determination unit determines that the earth and sand is in contact with the specific upper region of the bucket. In this configuration, in a case where the earth and sand in the bucket is in contact with the specific upper region, the bucket is displaced in the resistance reduction direction to reduce the excavation resistance. Thus, the amount of the earth and sand in the bucket can be sufficiently secured in the excavation work.

The work device control unit preferably outputs the resistance reduction command signal in a case where the contact state determination unit determines that the earth and sand is not in contact with the specific upper region of the bucket and the amount of the earth and sand accommodated in the accommodation space of the bucket is greater than the earth and sand amount threshold which is a predetermined threshold. In this configuration, in a case where the amount of the earth and sand in the bucket is greater than the earth and sand amount threshold even if the earth and sand in the bucket is not in contact with the specific upper region in the excavation work, the resistance reduction command signal is output. Therefore, the bucket is displaced in the resistance reduction direction to be able to reduce the excavation resistance before the earth and sand in the bucket contacts the specific upper region and thus the excavation resistance increases. Accordingly, wasteful energy consumption can be further prevented.

In the construction machine, the work device control unit may output the resistance reduction command signal in a case where the contact state determination unit determines that the earth and sand is not in contact with the specific upper region of the bucket and the excavation reaction force that is a reaction force received by the bucket from the ground in the excavation work is greater than a reaction force threshold that is a predetermined threshold. In this configuration, the reaction force threshold is preferably set to a value such that a great reduction in the bucket operation speed due to an increase in the excavation reaction force can be prevented. When the operation speed of the bucket greatly reduces, the efficiency of the excavation work is degraded. In this configuration, in a case where the excavation reaction force is greater than the reaction force threshold even if the earth and sand in the bucket is not in contact with the specific upper region, the bucket is displaced in the resistance reduction direction so that the excavation resistance is decreased. Therefore, the degradation in the efficiency of the excavation work can be further prevented.

Preferably, the construction machine further includes a work device attitude information acquisition device that acquires work device attitude information that is information regarding an attitude of the work device, and an earth and sand information acquisition device that acquires earth and sand information that is information regarding earth and sand accommodated in the accommodation space of the bucket, in which the controller further includes a bucket attitude calculation unit that calculates a bucket attitude that is an attitude of the bucket using the work device attitude information, and an accumulation state calculation unit that calculates an accumulation state of the earth and sand in the accommodation space of the bucket using the bucket attitude and the earth and sand information, the contact state determination unit determines a contact state between the specific upper region and the earth and sand based on the accumulation state. In this configuration, the contact state between the specific upper region and the earth and sand can be determined based on the actual accumulation state of the earth and sand in the bucket.

The construction machine may further include a load detector that is disposed in the specific upper region and is configured to detect an earth and sand load that is a load received from the earth and sand accommodated in the accommodation space of the bucket, in which the contact state determination unit may determine the contact state between the specific upper region and the earth and sand based on the earth and sand load detected by the load detector. In this configuration, since the contact state between the specific upper region and the earth and sand is determined based on the earth and sand load detected by the load detector, an increase in the processing load of the controller can be prevented as compared with, for example, the case of determining the contact state based on the image processing data.

Preferably, the controller further includes a tilt calculation unit that calculates a tilt index value that is an index value corresponding to a tilt of the specific upper region with respect to a predetermined reference plane, and the work device control unit does not output the resistance reduction command signal in a case where the tilt index value calculated by the tilt calculation unit is greater than a tilt threshold that is a predetermined threshold. The attitude of the bucket in the excavation work has a high correlation with the magnitude of the excavation resistance in the excavation work. Specifically, for example, in a case where the tilt of the specific upper region is great with respect to the horizontal plane (an example of the reference plane), the excavation resistance tends to decrease, and in a case where the tilt of the specific upper region is small with respect to the horizontal plane, the excavation resistance tends to increase. Therefore, in a case where the tilt index value is greater than the tilt threshold, the excavation resistance is likely not to need to be reduced in the excavation work, and in this case, the resistance reduction command signal is not output. As a result, the processing load of the controller can be reduced.

The invention claimed is:

1. A construction machine, comprising:

a machine body;

a work device including a boom supported to the machine body to be capable of being raised and lowered, an arm rotatably supported to the boom, and a bucket supported to the arm, the bucket having a bucket base end portion that is a base end portion rotatably attached to the arm about a horizontal axis, a bucket tip portion that is a tip portion on an opposite side of the bucket base end portion, and an inner surface defining an accommodation space that is a space capable of accommodating earth and sand;

at least one operation device including an operation lever configured to be operated by an operator, the at least one operation device being configured to cause the work device to perform excavation work so that earth and sand on a ground is excavated by displacing the bucket with respect to the ground while maintaining a state where a portion including at least the bucket tip portion is in contact with the ground at an excavation attitude that is a bucket attitude at which the bucket base end portion is disposed at a position higher than the bucket tip portion and is an attitude at which the earth and sand on the ground is capable of being excavated; and a controller, wherein the controller determines, during the excavation work, a contact state between a specific upper region and the earth and sand, the specific upper region being a portion located at an upper portion on the inner surface of the bucket at the excavation attitude, and outputs, in a case where the controller determines that the earth and sand is in contact with the specific upper region on the inner surface of the bucket during the excavation work, a resistance reduction command signal that is a command signal for operating the work device so that the bucket is displaced in a resistance reduction direction that is a direction where excavation resistance acting on the bucket is capable of being reduced, the resistance reduction direction being a direction in which a position of the horizontal axis which is a rotation center of the bucket base end portion is displaced upward or obliquely upward.

2. The construction machine according to claim 1, wherein the controller outputs the resistance reduction command signal in a case where a determination is made that the earth and sand is in contact with the specific upper region of the bucket, and does not output the resistance reduction command signal in a case where a determination is made that the earth and sand is not in contact with the specific upper region of the bucket.

3. The construction machine according to claim 1, wherein the controller outputs the resistance reduction command signal in a case where a determination is made that the earth and sand is not in contact with the specific upper region of the bucket and an amount of the earth and sand accommodated in the accommodation space of the bucket is greater than an earth and sand amount threshold that is a predetermined threshold, and does not output the resistance reduction command signal in a case where a determination is made that the earth and sand is not in contact with the specific upper region of the bucket and the amount of the earth and sand accommodated in the accommodation space of the bucket is equal to or lower than the earth and sand amount threshold.

4. The construction machine according to claim 1, wherein the controller outputs the resistance reduction command signal in a case where a determination is made that the earth and sand is not in contact with the specific upper region of the bucket and an excavation reaction force that is a reaction force received by the bucket from the ground in the excavation work is greater than a reaction force threshold that is a predetermined threshold, and does not output the resistance reduction command signal in a case where a determination is made that the earth and sand is not in contact with the specific upper region of the bucket and the excavation reaction force is equal to or lower than the reaction force threshold.

5. The construction machine according to claim 1, further comprising:

a work device attitude information acquisition device that acquires work device attitude information that is information regarding an attitude of the work device; and an earth and sand information acquisition device that acquires earth and sand information that is information regarding the earth and sand accommodated in the accommodation space of the bucket, wherein the controller calculates a bucket attitude that is the attitude of the bucket using the work device attitude information, and calculates an accumulation state of the earth and sand in the accommodation space of the bucket using the bucket attitude and the earth and sand information, and the controller determines the contact state between the specific upper region and the earth and sand based on the accumulation state.

6. The construction machine according to claim 1, further comprising a load detector that is disposed in the specific upper region and is configured to detect an earth and sand load that is a load received from the earth and sand accommodated in the accommodation space of the bucket, wherein the controller determines the contact state between the specific upper region and the earth and sand based on the earth and sand load detected by the load detector.

7. The construction machine according to claim 1, wherein the controller calculates a tilt index value that is an index value corresponding to a tilt of the specific upper region with respect to a predetermined reference plane, and the controller does not output the resistance reduction command signal in a case where the tilt index value is greater than a tilt threshold that is a predetermined threshold.

* * * * *